US011205546B2

(12) United States Patent
Hotta et al.

(10) Patent No.: US 11,205,546 B2
(45) Date of Patent: Dec. 21, 2021

(54) SWITCH

(71) Applicant: Mitsubishi Electric Corporation, Tokyo (JP)

(72) Inventors: Katsuki Hotta, Tokyo (JP); Takashi Inaguchi, Tokyo (JP); Kazuki Takahashi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 118 days.

(21) Appl. No.: 16/614,803

(22) PCT Filed: Jun. 15, 2018

(86) PCT No.: PCT/JP2018/022884
§ 371 (c)(1),
(2) Date: Nov. 19, 2019

(87) PCT Pub. No.: WO2019/021673
PCT Pub. Date: Jan. 31, 2019

(65) Prior Publication Data

US 2020/0203094 A1 Jun. 25, 2020

(30) Foreign Application Priority Data

Jul. 26, 2017 (JP) ..... JP2017-144406

(51) Int. Cl.
*H01H 67/02* (2006.01)
*H01H 9/44* (2006.01)
*H01H 1/54* (2006.01)

(52) U.S. Cl.
CPC ..... *H01H 9/443* (2013.01); *H01H 1/54* (2013.01); *H01H 2001/545* (2013.01)

(58) Field of Classification Search
CPC .... H01H 9/443; H01H 1/54; H01H 2001/545; H01H 9/36; H01H 50/546; H01H 50/38; H01H 9/446; H01H 33/18
(Continued)

(56) References Cited

U.S. PATENT DOCUMENTS 4,302,742 A * 11/1981 Schedele ..... H01H 50/58 335/202
4,658,226 A * 4/1987 Maenishi ..... H01H 50/026 335/121
(Continued)

FOREIGN PATENT DOCUMENTS

JP H01-109155 U 7/1989
JP 2003-197053 A 7/2003
(Continued)

OTHER PUBLICATIONS

Application as filed in related U.S. Appl. No. 16/649,992, filed Mar. 24, 2020, 56 pages.
(Continued)

*Primary Examiner* — Shawki S Ismail
*Assistant Examiner* — Lisa N Homza
(74) *Attorney, Agent, or Firm* — Xsensus LLP

(57) ABSTRACT

A switch includes a first fixed contact, a second fixed contact, a movable contact, a drive shaft, a first outside yoke, a second outside yoke, a first inside yoke, a second inside yoke, and a permanent magnet. The permanent magnet magnetically couples the first outside yoke, the second outside yoke, the first inside yoke, and the second inside yoke, and produces a magnetic field component in a direction in which the first fixed contact point and the second fixed contact point are aligned, between the first fixed
(Continued)

contact point and the first movable contact point and between the second fixed contact point and the second movable contact point.

10 Claims, 13 Drawing Sheets

(58) Field of Classification Search
USPC ..... 335/129
See application file for complete search history.

(56) References Cited

U.S. PATENT DOCUMENTS

| | | | | |
|---|---|---|---|---|
| 2003/0085784 | A1* | 5/2003 | Weber | H01H 50/541 335/129 |
| 2013/0335177 | A1 | 12/2013 | Enomoto | |
| 2014/0176268 | A1* | 6/2014 | Suzuki | H01H 9/443 335/201 |
| 2015/0022292 | A1* | 1/2015 | Tachikawa | H01H 49/00 335/131 |
| 2015/0318134 | A1* | 11/2015 | Connell | H01H 50/14 335/133 |
| 2016/0035502 | A1* | 2/2016 | Zhong | H01H 50/42 335/170 |
| 2016/0079022 | A1* | 3/2016 | An | H01H 50/32 335/187 |
| 2016/0181038 | A1* | 6/2016 | Shimizu | H01H 50/54 335/165 |
| 2016/0233039 | A1* | 8/2016 | Kanematsu | H01H 50/00 |
| 2016/0314925 | A1* | 10/2016 | Birner | H01H 51/065 |
| 2017/0069450 | A1* | 3/2017 | Birner | H01H 9/043 |
| 2021/0193421 | A1* | 6/2021 | Yoo | H01H 1/54 |

FOREIGN PATENT DOCUMENTS

| | | | |
|---|---|---|---|
| JP | 2013-187053 | A | 9/2013 |
| WO | 2012/128080 | A1 | 9/2012 |

OTHER PUBLICATIONS

International Search Report and Written Opinion dated Sep. 11, 2018 for PCT/JP2018/022884 filed on Jun. 15, 2018, 11 pages including English Translation of the International Search Report.

* cited by examiner

SWITCH

CROSS-REFERENCE TO RELATED APPLICATIONS

The present application is based on PCT filing PCT/JP2018/022884, filed Jun. 15, 2018, which claims priority to JP 2017-144406, filed Jul. 26, 2017, the entire contents of each are incorporated herein by reference.

TECHNICAL FIELD

The present invention relates to a switch.

BACKGROUND ART

Prior art documents disclosing a configuration of switches include Japanese Utility Model Laying-Open No. H1-109155 (PTL 1), WO2012/128080 (PTL 2), and Japanese Patent Laying-Open No. 2003-197053 (PTL 3).

The direct-current switch disclosed in PTL 1 includes a fixed contact having a fixed contact point, a movable contact having a movable contact point, a crossbar, a magnetic plate, and a permanent magnet. A magnetic field component in a direction vertical to the extending direction of the movable contact is produced between the fixed contact point and the movable contact point by the permanent magnet and the magnetic plate. An arc produced between the fixed contact point and the movable contact point is extended outward in the extending direction of the movable contact by this magnetic field component and extinguished.

The contact device disclosed in PTL 2 includes a fixed contact having fixed contact points, a movable contact having movable contact points, and a pair of permanent magnets sandwiching a pair of fixed contact points. When current flows through the movable contact in one direction, an arc produced between the contact points on one side is extended to one side of the direction vertical to the extending direction of the movable contact, and an arc produced between the contact points on the other side is extended to the opposite direction. When current flows through the movable contact in the other direction, the drive directions of the arcs are reversed.

The switch disclosed in PTL 3 includes a fixed contact having fixed contact points, a movable contact having movable contacts, an operating member coupled to the movable contact to open the contact points, magnetic field generating means for generating a magnetic field in the vicinity of the contact points, and magnetic lines of force guiding members. The magnetic field generating means generates a magnetic field in a direction along the extending direction of the movable contact between the fixed contact point and the movable contact point.

CITATION LIST

Patent Literature

PTL 1: Japanese Utility Model Laying-Open No. H1-109155

PTL 2: WO2012/128080

PTL 3: Japanese Patent Laying-Open No. 2003-197053

SUMMARY OF INVENTION

Technical Problem

In the switch disclosed in PTL 3, the magnetic lines of force guiding members are arranged symmetrically along the outer wall of the arc-extinguishing chamber case so as to extend along the magnetic line of force passing through the first contact point and the second contact point. There is therefore room to even more effectively exert a drive force on the arc.

The present invention is made in view of the problem above and an object of the present invention is to provide a switch with a high arc-extinguishing performance, in which a drive force is effectively exerted on an arc.

Solution to Problem

A switch based on the present invention includes a first fixed contact, a second fixed contact, a movable contact, a drive shaft, a first outside yoke, a second outside yoke, a first inside yoke, a second inside yoke, and a permanent magnet. The first fixed contact has a first fixed contact point. The second fixed contact is disposed symmetrically to be aligned in a row with a gap from the first fixed contact. The second fixed contact has a second fixed contact point. The movable contact is disposed to a side of the first fixed contact point and the second fixed contact point. The movable contact has a first movable contact point at one end portion at a position facing the first fixed contact point and a second movable contact point at another end portion at a position facing the second fixed contact point. The drive shaft is formed of an insulator. The drive shaft is disposed to pass through the gap. The drive shaft moves the movable contact to the side. The first outside yoke is formed of a magnetic substance. A part of the first outside yoke is located at a position outside the one end portion of the movable contact in a direction in which the first fixed contact point and the second fixed contact point are aligned. The second outside yoke is formed of a magnetic substance. A part of the second outside yoke is located at a position outside the other end portion of the movable contact in the direction aligned. The first inside yoke is formed of a magnetic substance. A part of the first inside yoke is located at a position between the first fixed contact and the drive shaft. The second inside yoke is formed of a magnetic substance. A part of the second inside yoke is located at a position between the second fixed contact and the drive shaft. The permanent magnet is connected to each of the first outside yoke and the second outside yoke. The permanent magnet magnetically couples the first outside yoke, the second outside yoke, the first inside yoke, and the second inside yoke, and produces a magnetic field component in the direction aligned, between the first fixed contact point and the first movable contact point and between the second fixed contact point and the second movable contact point.

Advantageous Effects of Invention

According to the present invention, a drive force can be effectively exerted on an arc, and the arc-extinguishing performance of the switch can be enhanced.

DESCRIPTION OF EMBODIMENTS

Figure 1:
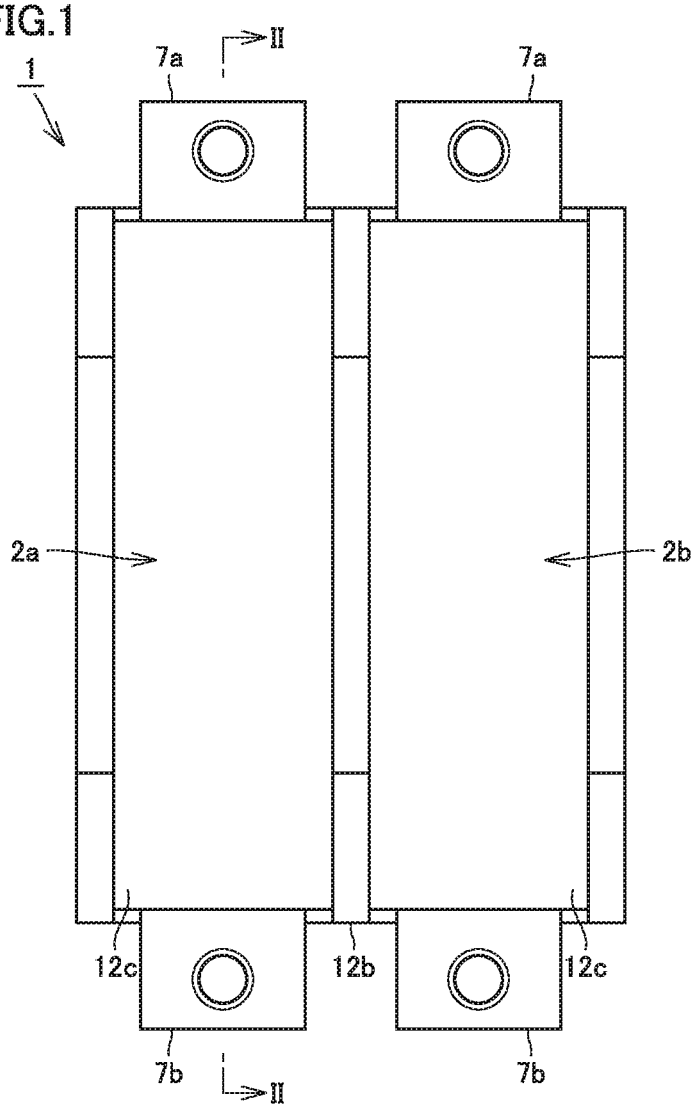
FIG. 1 is a front view of the appearance of a switch according to a first embodiment of the present invention.

A switch according to embodiments of the present invention will be described below with reference to the drawings. In the following description of embodiments, the same or corresponding parts in the drawings are denoted by the same reference signs and a description thereof will not be repeated.

First Embodiment

Figure 2:
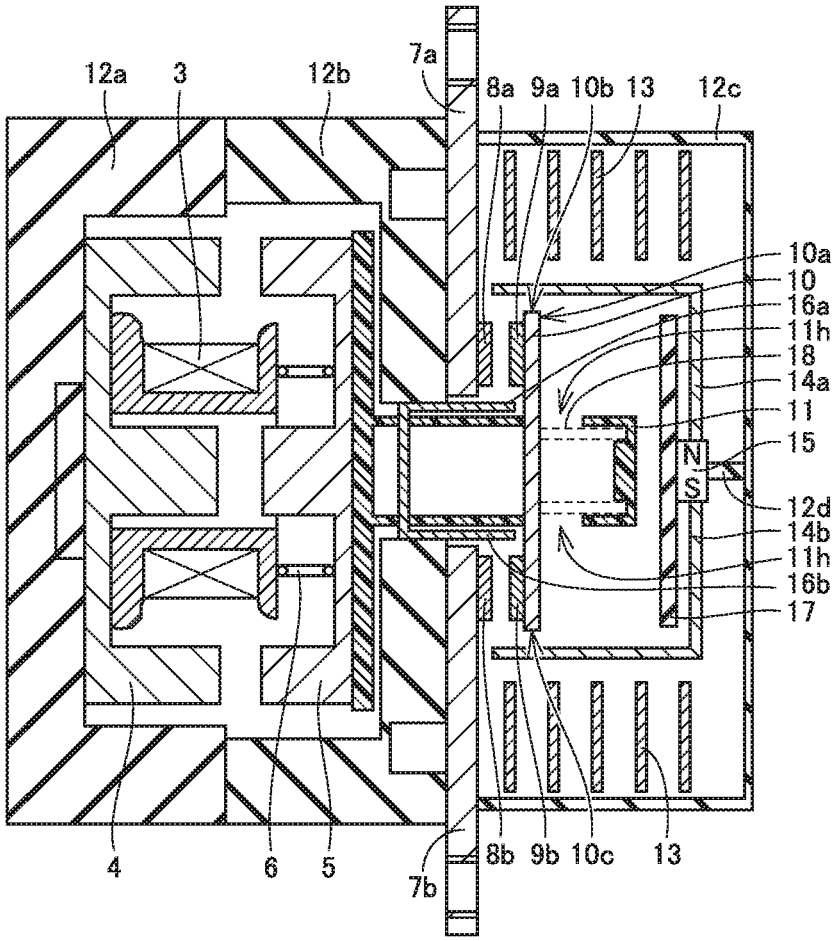
FIG. 2 is a cross-sectional view of the switch in FIG. 1 as viewed from the direction of arrows II-II.
Figure 3:
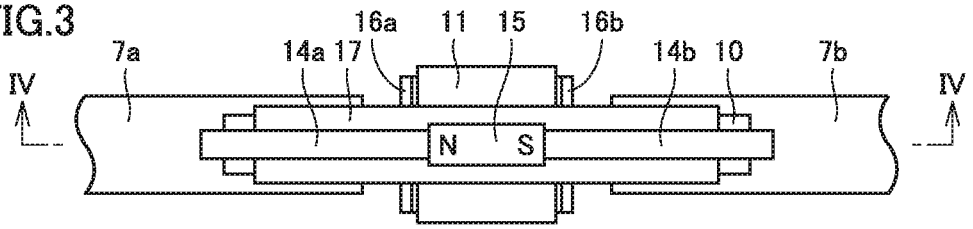
FIG. 3 is a partial enlarged view of the switch according to the first embodiment of the present invention with an arc cover removed as viewed from the front side.
Figure 4:
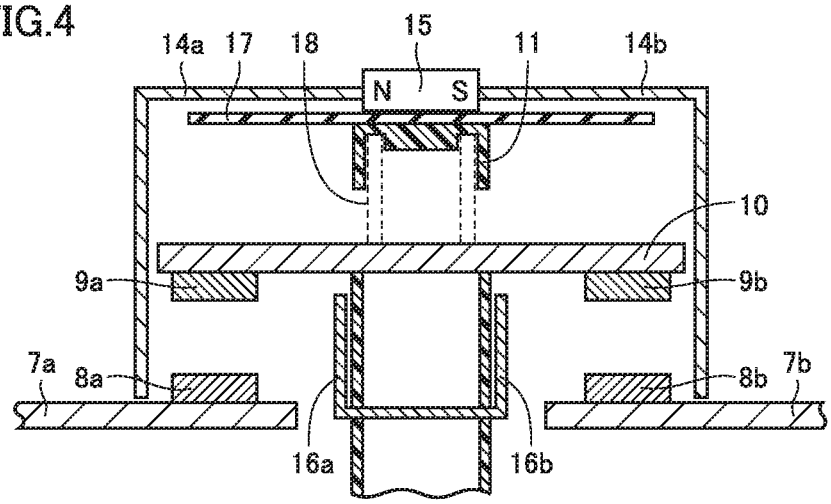
FIG. 4 is a cross-sectional view as viewed from the direction of arrows IV-IV in FIG. 3.

FIG. 1 is a front view of the appearance of a switch according to a first embodiment of the present invention. FIG. 2 is a cross-sectional view of the switch in FIG. 1 as viewed from the direction of arrows II-II. FIG. 3 is a partial enlarged view of the switch according to the first embodiment of the present invention with an arc cover removed as viewed from the front side. FIG. 4 is a cross-sectional view as viewed from the direction of arrows Iv-Iv in FIG. 3.

As shown in FIG. 1, switch 1 according to the first embodiment of the present invention includes a first-phase arc-extinguishing chamber 2*a* and a second-phase arc-extinguishing chamber 2*b*. First-phase arc-extinguishing chamber 2*a* and second-phase arc-extinguishing chamber 2*b* have configurations similar to each other. As shown in FIG. 1, switch 1 has a vertically symmetric shape and a horizontally symmetric shape. Switch 1 has at least one arc-extinguishing chamber.

As shown in FIG. 2 to FIG. 4, switch 1 according to the first embodiment of the present invention includes a first fixed contact 7*a*, a second fixed contact 7*b*, a movable contact 10, a drive shaft 11, a first outside yoke 14*a*, a second outside yoke 14*b*, a first inside yoke 16*a*, a second inside yoke 16*b*, and a permanent magnet 15. Switch 1 further includes a grid 13, an insulating plate 17, and an arc cover 12*c*.

First fixed contact 7*a* has a first fixed contact point 8*a*. First fixed contact 7*a* has an approximately rectangular parallelepiped outer shape. First fixed contact 7*a* has a longitudinal direction and has a through hole at one end portion in the longitudinal direction. First fixed contact point 8*a* is provided on one main surface of first fixed contact 7*a*. First fixed contact point 8*a* is located at the other end portion in the longitudinal direction of first fixed contact 7*a*.

Second fixed contact 7*b* is disposed symmetrically to be aligned in a row with a gap from first fixed contact 7*a* and has a second fixed contact point 8*b*. Second fixed contact 7*b* has an approximately rectangular parallelepiped outer shape. Second fixed contact 7*b* has a longitudinal direction and has a through hole at the other end portion in the longitudinal direction. Second fixed contact point 8*b* is provided on one main surface of second fixed contact 7*b*. Second fixed contact point 8*b* is located at one end portion in the longitudinal direction of second fixed contact 7*b*.

Movable contact 10 extends in an extending direction along the direction in which the first fixed contact point 8*a* and the second fixed contact point 8*b* are aligned. Movable contact 10 is disposed to the side of first fixed contact point 8*a* and second fixed contact point 8*b*. Movable contact 10 has an approximately rectangular parallelepiped outer shape. Movable contact 10 has a longitudinal direction which is the extending direction. Movable contact 10 has a first movable contact point 9*a* at one end portion in the extending direction and has a second movable contact point 9*b* at the other end portion in the extending direction. First movable contact point 9*a* and second movable contact point 9*b* are provided on the other main surface of movable contact 10.

First fixed contact point 8*a* and first movable contact point 9*a* face each other. First movable contact point 9*a* is provided to be able to come into contact with and separate from first fixed contact point 8*a*. Second fixed contact point 8*b* and second movable contact point 9*b* face each other. Second movable contact point 9*b* is provided to be able to come into contact with and separate from second fixed contact point 8*b*.

Drive shaft 11 is formed of an insulator. Drive shaft 11 is disposed to pass through a gap between first fixed contact 7*a* and second fixed contact 7*b*. Drive shaft 11 moves movable contact 10 in the axial direction vertical to the extending direction of movable contact 10 while keeping first fixed contact point 8*a* and first movable contact point 9*a* facing each other and while keeping second fixed contact point 8*b* and second movable contact point 9*b* facing each other. Drive shaft 11 thus moves movable contact 10 to the above-noted side.

Drive shaft 11 has a hollow portion on the front end side, and a contact pressure spring 18 is accommodated in the hollow portion. Drive shaft 11 has a pair of hole portions 11*h* into which movable contact 10 is inserted. Each of a pair of hole portions 11*h* extends along the axial direction of drive shaft 11. Drive shaft 11 is formed of resin or plastic having insulating properties. Contact pressure spring 18 is sandwiched between an inner surface on the front end side of drive shaft 11 and one main surface 10*a* of movable contact 10.

Permanent magnet 15 is provided at a position on the opposite side to first fixed contact 7*a* and second fixed contact 7*b* in the axial direction of drive shaft 11 with respect to movable contact 10. In the present embodiment, switch 1 includes only one permanent magnet 15 in each arc-extinguishing chamber. Insulating plate 17 is attached to a surface of permanent magnet 15 on the movable contact 10 side.

Insulating plate 17 has an approximately rectangular parallelepiped outer shape. Insulating plate 17 has a longitudinal direction in a direction along the extending direction of movable contact 10. The width of insulating plate 17 is larger than the width of permanent magnet 15 in a width direction vertical to each of the extending direction of movable contact 10 and the axial direction of drive shaft 11. As viewed from the axial direction of drive shaft 11, permanent magnet 15 as a whole overlaps insulating plate 17.

A support 12*d* is attached on a surface of permanent magnet 15 on the opposite side to the surface having insulating plate 17. Permanent magnet 15 is fixed to arc cover 12*c* by support 12*d*. In the present embodiment, permanent magnet 15 has a north pole on the first outside yoke 14*a* side and a south pole on the second outside yoke 14*b* side. The orientation of magnetic poles of permanent magnet 15 may be reversed.

First outside yoke 14*a* is formed of a magnetic substance such as iron, for example. One end of first outside yoke 14*a* is connected to permanent magnet 15. The other end of first outside yoke 14*a* is located in the vicinity of first fixed contact point 8*a* and first movable contact point 9*a*.

In the present embodiment, first outside yoke 14*a* has a portion extending in a direction along the extending direction of movable contact 10 and a portion extending in a direction along the axial direction of drive shaft 11. The portion extending in the direction along the extending direction of movable contact 10 in first outside yoke 14*a* faces one main surface 10*a* of movable contact 10 with a spacing therefrom. The portion extending in the direction along the axial direction of drive shaft 11 in first outside yoke 14*a* faces one end surface 10*b* of movable contact 10 with a spacing therefrom.

The shape of first outside yoke 14*a* is not limited to the shape described above as long as a part of first outside yoke 14*a* is located at a position outside one end portion of movable contact 10 in the direction along the extending direction of movable contact 10 as viewed from the axial direction of drive shaft 11, within a range in which a magnetic field component described later can be produced. That is, a part of first outside yoke 14*a* is located at a position outside one end portion of movable contact 10 in a direction in which first fixed contact point 8*a* and second fixed contact point 8*b* are aligned.

Second outside yoke 14*b* is formed of a magnetic substance such as iron, for example. One end of second outside yoke 14*b* is connected to permanent magnet 15. The other end of second outside yoke 14*b* is located in the vicinity of second fixed contact point 8*b* and second movable contact point 9*b*.

In the present embodiment, second outside yoke 14*b* has a portion extending in a direction along the extending direction of movable contact 10 and a portion extending in a direction along the axial direction of drive shaft 11. The portion extending in a direction along the extending direction of movable contact 10 in second outside yoke 14*b* faces one main surface 10*a* of movable contact 10 with a spacing therefrom. The portion extending in a direction along the axial direction of drive shaft 11 in second outside yoke 14*b* faces the other end surface 10*c* of movable contact 10 with a spacing therefrom.

The shape of second outside yoke 14*b* is not limited to the shape described above as long as a part of second outside yoke 14*b* is located at a position outside the other end portion of movable contact 10 in a direction along the extending direction of movable contact 10 as viewed from the axial direction of drive shaft 11, within a range in which a magnetic field component described later can be produced. That is, a part of second outside yoke 14*b* is located at a position outside the other end portion of movable contact 10 in a direction in which first fixed contact point 8*a* and second fixed contact point 8*b* are aligned.

Figure 5:
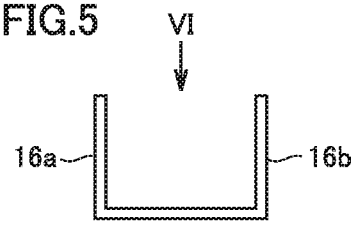
FIG. 5 is a view of the appearance of a member forming the inside yoke of the switch according to the first embodiment of the present invention as viewed from the side.
Figure 6:
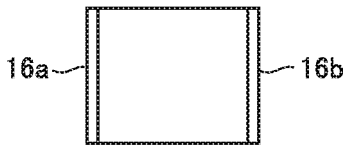
FIG. 6 is a view of the member forming the inside yoke in FIG. 5 as viewed from the direction of arrow VI.

FIG. 5 is a view of the appearance of a member forming the inside yoke of the switch according to the first embodiment of the present invention as viewed from the side. FIG. 6 is a view of the member forming the inside yoke in FIG. 5 as viewed from the direction of arrow VI.

As shown in FIG. 5 and FIG. 6, in the present embodiment, first inside yoke 16*a* and second inside yoke 16*b* are integrally formed. The member forming the inside yoke is formed of a magnetic substance such as iron, for example. The member forming the inside yoke is formed by bending a plate-shaped magnetic substance.

First inside yoke 16*a* and second inside yoke 16*b* face each other with a spacing therebetween. Each of first inside yoke 16*a* and second inside yoke 16*b* has a flat plate-like shape. Each of first inside yoke 16*a* and second inside yoke 16*b* has a rectangular shape as viewed from the direction in which they face each other.

One end portion of first inside yoke 16*a* and one end portion of second inside yoke 16*b* are connected to each other by a connection portion extending in a direction vertical to each of first inside yoke 16*a* and second inside yoke 16*b*. This connection portion is attached to drive shaft 11 so as to extend in a direction vertical to the axial direction of drive shaft 11. As a result, each of first inside yoke 16*a* and second inside yoke 16*b* is connected to drive shaft 11. In the present embodiment, the member forming the inside yoke and drive shaft 11 are integrally formed.

First inside yoke 16*a* is located at a position between first fixed contact 7*a* and drive shaft 11, as viewed from the axial direction of drive shaft 11. Second inside yoke 16*b* is located at a position between second fixed contact 7*b* and drive shaft 11, as viewed from the axial direction of drive shaft 11.

In the present embodiment, a part of first outside yoke 14*a* and a part of first inside yoke 16*a* face each other between first fixed contact point 8*a* and first movable contact point 9*a*, as viewed from a direction along the extending direction of movable contact 10. In the above-noted width direction, the outer width of first inside yoke 16*a* is larger than the outer width of first outside yoke 14*a*.

First outside yoke 14*a* and first inside yoke 16*a* do not necessarily face each other. However, it is preferable that a part of first outside yoke 14*a* and a part of first inside yoke 16*a* are located between first fixed contact point 8*a* and first movable contact point 9*a* as viewed from a direction along the extending direction of movable contact 10, in terms of producing a magnetic field component described later. The outer width of first inside yoke 16*a* may be equivalent to the outer width of first outside yoke 14*a*.

In the present embodiment, a part of second outside yoke 14*b* and a part of second inside yoke 16*b* face each other between second fixed contact point 8*b* and second movable contact point 9*b*, as viewed from a direction along the extending direction of movable contact 10. In the above-noted width direction, the outer width of second inside yoke 16*b* is larger than the outer width of second outside yoke 14*b*.

Second outside yoke 14*b* and second inside yoke 16*b* do not necessarily face each other. However, it is preferable that a part of second outside yoke 14*b* and a part of second inside yoke 16*b* are located between second fixed contact point 8*b* and second movable contact point 9*b* as viewed from a direction along the extending direction of movable contact 10, in terms of producing a magnetic field component described later. The outer width of second inside yoke 16*b* may be equivalent to the outer width of second outside yoke 14*b*.

Arc cover 12*c* is formed of an insulator. Grid 13 is provided on an inner surface of arc cover 12*c*. Grid 13 is formed of a non-magnetic metal such as stainless steel or copper or a non-magnetic ceramic. Grid 13 is electrically insulated from first fixed contact 7*a*, second fixed contact 7*b*, first fixed contact point 8*a*, second fixed contact point 8*b*, first movable contact point 9*a*, second movable contact point 9*b*, and movable contact 10. In the present embodiment, grid 13 is provided in order to further enhance the arc interruption performance. However, grid 13 is not necessarily provided.

As shown in FIG. 2, a region surrounded by first fixed contact 7*a*, second fixed contact 7*b*, and arc cover 12*c* serves as an arc-extinguishing chamber.

As shown in FIG. 2, switch 1 according to the first embodiment of the present invention further includes an operating coil 3, a fixed core 4, a movable core 5, a tripping spring 6, a mount 12*a*, and a base 12*b*.

Mount 12*a* and base 12*b* are connected to each other to form a box. The box accommodates operating coil 3, movable core 5, fixed core 4, and tripping spring 6. Operating coil 3 is disposed on the outer peripheral side of the leg at movable core 5 and fixed core 4. Fixed core 4 is fixed to mount 12*a*. Tripping spring 6 is sandwiched between operating coil 3 and movable core 5. Movable core 5 is connected to drive shaft 11.

Base 12*b* has an opening into which drive shaft 11 is inserted. First fixed contact 7*a* and second fixed contact 7*b* are attached to base 12*b* on the opposite side to mount 12*a*.

Each of mount 12*a* and base 12*b* is formed of an insulator. Since first fixed contact 7*a* and second fixed contact 7*b* are attached to base 12*b*, a material excellent in heat resistance and insulating properties, such as synthetic resin or a material including a glass material in synthetic resin, is used for base 12*b*.

Each of movable core 5 and fixed core 4 is formed of a magnetic substance such as iron, for example. Each of movable core 5 and fixed core 4 may be formed with a stack of magnetic steel sheets.

The operation of switch 1 according to the first embodiment of the present invention will be described below.

When switch 1 is closed, first, operating coil 3 is energized. With operating coil 3 being energized, movable core 5 is pulled to fixed core 4 against the biasing force of tripping spring 6. Then, drive shaft 11 fixed to movable core 5 is also moved toward fixed core 4. With the movement of drive shaft 11, movable contact 10 also moves, first movable contact point 9*a* comes into contact with first fixed contact point 8*a*, and second movable contact point 9*b* comes into contact with second fixed contact point 8*b*.

Even after first movable contact point 9*a* comes into contact with first fixed contact point 8*a* and second movable contact point 9*b* comes into contact with second fixed contact point 8*b*, drive shaft 11 keeps moving toward fixed core 4. At this moment, movable contact 10 moves near the front end of drive shaft 11 in a pair of hole portions 11*h* of drive shaft 11 while flexing contact pressure spring 18.

The biasing force of contact pressure spring 18 presses first movable contact point 9*a* against first fixed contact point 8*a* and presses second movable contact point 9*b* against second fixed contact point 8*b*. Thus, the contact resistance between first movable contact point 9*a* and first fixed contact point 8*a* can be sufficiently reduced. The contact resistance between second movable contact point 9*b* and second fixed contact point 8*b* also can be sufficiently reduced.

Through the operation above, first fixed contact 7*a*, first fixed contact point 8*a*, first movable contact point 9*a*, movable contact 10, second movable contact point 9*b*, second fixed contact point 8*b*, and second fixed contact 7*b* are electrically connected to bring switch 1 into the closed state. With switch 1 in the closed state, forward current or reverse current described later is fed through switch 1.

When switch 1 is opened, the energization of operating coil 3 is stopped. Movable core 5 is pulled apart from fixed core 4 by the biasing force of tripping spring 6. Thus, drive shaft 11 fixed to movable core 5 also moves in a direction away from fixed core 4. At this moment, contact pressure spring 18 extends with the movement of drive shaft 11, and the biasing force of contact pressure spring 18 decreases.

When movable contact 10 comes into contact with the base ends of a pair of hole portions 11*h* of drive shaft 11 and starts moving together with drive shaft 11, first movable contact point 9*a* is detached from first fixed contact point 8*a*, and second movable contact point 9*b* is detached from second fixed contact point 8*b*.

Through the operation above, switch 1 becomes opened. At the moment when first movable contact point 9*a* is detached from first fixed contact point 8*a*, a high-temperature arc occurs between first movable contact point 9*a* and first fixed contact point 8*a*. Similarly, at the moment when second movable contact point 9*b* is detached from second fixed contact point 8*b*, a high-temperature occurs between second movable contact point 9*b* and second fixed contact point 8*b*. Since an arc has conductivity, current flows through the original current path until the arc is extinguished even after opening of the switch.

Figure 7:
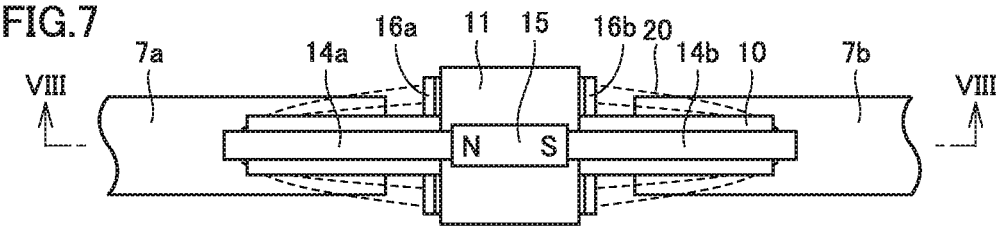
FIG. 7 is a partial enlarged view schematically showing the produced magnetic field distribution as viewed from the front side of the switch according to the first embodiment of the present invention with the arc cover removed.
Figure 8:
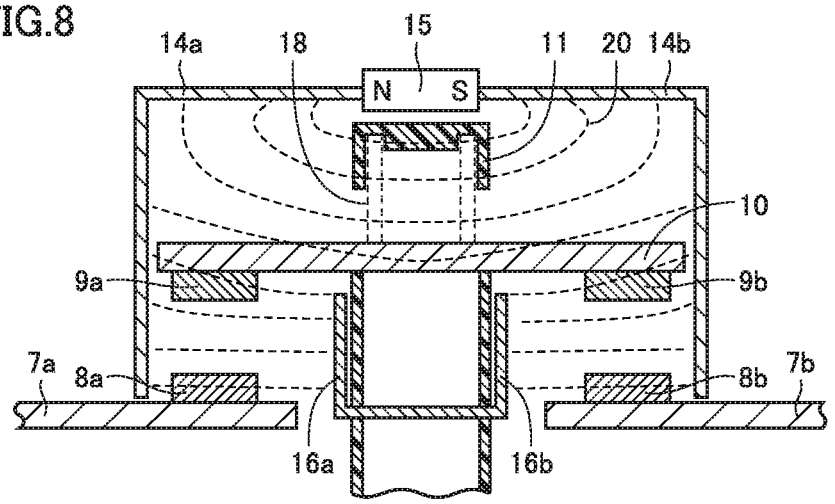
FIG. 8 is a cross-sectional view as viewed from the direction of arrows VIII-VIII in FIG. 7.

A magnetic field produced by permanent magnet 15 in switch 1 according to the first embodiment of the present invention will now be described. FIG. 7 is a partial enlarged view schematically showing the produced magnetic field distribution, as viewed from the front side of the switch according to the first embodiment of the present invention with the arc cover removed. FIG. 8 is a cross-sectional view as viewed from the direction of arrows VIII-VIII in FIG. 7. In FIG. 7 and FIG. 8, insulating plate 17 is not shown.

As shown in FIG. 7 and FIG. 8, magnetic flux 20 is distributed in a closed loop shape emitted from the north pole of permanent magnet 15 toward the south pole of permanent magnet 15. Magnetic flux 20 intensively passes through first outside yoke 14*a*, first inside yoke 16*a*, second inside yoke 16*b*, and second outside yoke 14*b* which are formed of a magnetic substance having the property of allowing magnetic flux to easily pass through in the air. That is, permanent magnet 15 magnetically couples first outside yoke 14*a*, second outside yoke 14*b*, first inside yoke 16*a*, and second inside yoke 16*b*.

As a result, permanent magnet 15 produces a magnetic field component in a direction along the extending direction of movable contact 10 between first fixed contact point 8*a* and first movable contact point 9*a* and between second fixed contact point 8*b* and second movable contact point 9*b*. That is, permanent magnet 15 produces a magnetic field component in a direction in which first fixed contact point 8*a* and second fixed contact point 8*b* are aligned, between first fixed contact point 8*a* and first movable contact point 9*a* and between second fixed contact point 8*b* and second movable contact point 9*b*.

In the present embodiment, as shown in FIG. 7, since the outer width of first inside yoke 16*a* is larger than outer width of first outside yoke 14*a*, magnetic flux 20 is distributed so as to expand in the above-noted width direction in the vicinity of first inside yoke 16*a* and to converge in the vicinity of first outside yoke 14*a*. Similarly, since the outer width of second inside yoke 16*b* is larger than the outer width of second outside yoke 14*b*, magnetic flux 20 is distributed so as to expand in the above-noted width direction in the vicinity of second inside yoke 16*b* and to converge in the vicinity of second outside yoke 14*b*.

Figure 9:
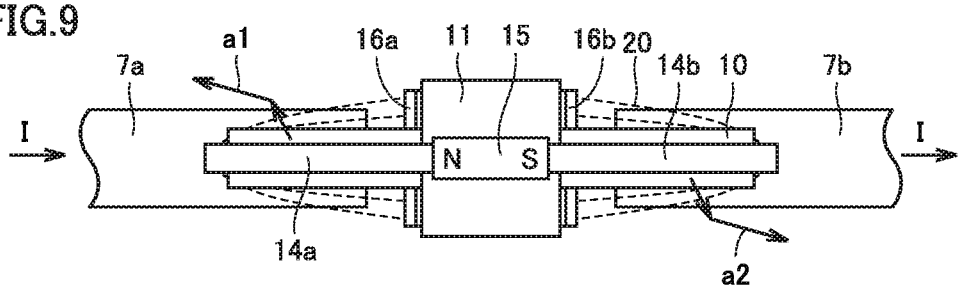
FIG. 9 is a partial enlarged view schematically showing a drive force acting on an arc produced when forward current flows, as viewed from the front side of the switch according to the first embodiment of the present invention with the arc cover removed.

FIG. 9 is a partial enlarged view schematically showing a drive force acting on an arc produced when forward current flows, as viewed from the front side of the switch according to the first embodiment of the present invention with the arc cover removed. In FIG. 9, insulating plate 17 is not shown.

As shown in FIG. 9, current I flowing through first fixed contact 7*a*, first fixed contact point 8*a*, first movable contact point 9*a*, movable contact 10, second movable contact point 9*b*, second fixed contact point 8*b*, and second fixed contact 7*b* in this order is regarded as forward current.

When forward current flows, according to Fleming's rule, drive force a1 acts on the arc produced between first fixed contact point 8*a* and first movable contact point 9*a*, and drive force a2 acts on the arc produced between second fixed contact point 8*b* and second movable contact point 9*b*.

In the region sandwiched between first outside yoke 14*a* and first inside yoke 16*a* in the extending direction of movable contact 10, there is a tendency that magnetic flux 20 develops in a direction along the extending direction of movable contact 10 and the development direction of magnetic flux 20 is inclined to the above-noted width direction as the distance from this region increases in the above-noted width direction. This tendency significantly appears since the outer width of first inside yoke 16*a* is larger than the outer width of first outside yoke 14*a* in the present embodiment.

For the arc produced between first fixed contact point 8*a* and first movable contact point 9*a*, drive force a1 therefore mainly acts on one side in the above-noted width direction and thereafter mainly acts in a direction away from movable contact 10 in the extending direction of movable contact 10. As a result, the arc produced between first fixed contact point 8*a* and first movable contact point 9*a* is extended long under the action of drive force a1.

Similarly, for the arc produced between second fixed contact point 8*b* and second movable contact point 9*b*, drive force a2 mainly acts on the other side in the above-noted width direction and thereafter mainly acts in a direction away from movable contact 10 in the extending direction of movable contact 10. As a result, the arc produced between second fixed contact point 8*b* and second movable contact point 9*b* is extended long under the action of drive force a2.

Figure 10:
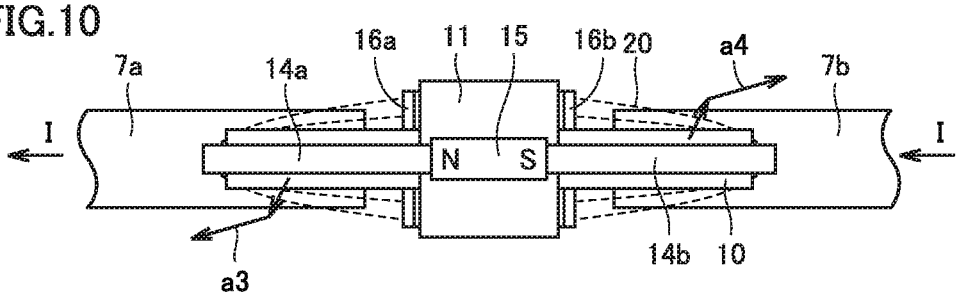
FIG. 10 is a partial enlarged view schematically showing a drive force acting on an arc produced when reverse current flows, as viewed from the front side of the switch according to the first embodiment of the present invention with the arc cover removed.

FIG. 10 is a partial enlarged view schematically showing a drive force acting on an arc produced when reverse current flows, as viewed from the front side of the switch according to the first embodiment of the present invention with the arc cover removed. In FIG. 10, insulating plate 17 is not shown.

As shown in FIG. 10, current I flowing through second fixed contact 7*b*, second fixed contact point 8*b*, second movable contact point 9*b*, movable contact 10, first movable contact point 9*a*, first fixed contact point 8*a*, and first fixed contact 7*a* in this order is regarded as reverse current.

When reverse current flows, according to Fleming's rule, drive force a3 acts on the arc produced between first fixed contact point 8*a* and first movable contact point 9*a*, and drive force a4 acts on the arc produced between second fixed contact point 8*b* and second movable contact point 9*b*.

For the arc produced between first fixed contact point 8*a* and first movable contact point 9*a*, drive force a3 mainly acts on the other side in the above-noted width direction and thereafter mainly acts in a direction away from movable contact 10 in the extending direction of movable contact 10. As a result, the arc produced between first fixed contact point 8*a* and first movable contact point 9*a* is extended long under the action of drive force a3.

Similarly, for the arc produced between second fixed contact point 8*b* and second movable contact point 9*b*, drive force a4 mainly acts on one side in the above-noted width direction and thereafter mainly acts in a direction away from movable contact 10 in the extending direction of movable contact 10. As a result, the arc produced between second fixed contact point 8*b* and second movable contact point 9*b* is extended long under the action of drive force a4.

As described above, in switch 1 according to the first embodiment of the present invention, both when forward current flows and when reverse current flows, the drive force can be exerted on the arc on either side in the above-noted width direction and thereafter exerted in a direction away from movable contact 10 in the extending direction of movable contact 10.

The arc extended under the action of drive force is extended up to a sufficiently long arc length or cooled in contact with grid 13 and extinguished. Current I is thus interrupted.

In switch 1 according to the first embodiment of the present invention, permanent magnet 15 magnetically couples first outside yoke 14*a*, second outside yoke 14*b*, first inside yoke 16*a*, and second inside yoke 16*b*, and produces a magnetic field component in a direction along the extending direction of movable contact 10 between first fixed contact point 8*a* and first movable contact point 9*a* and between second fixed contact point 8*b* and second movable contact point 9*b*. As a result, the drive force can be effectively exerted on the arc, and the arc-extinguishing performance of switch 1 can be enhanced.

In particular, in the above-noted width direction, the outer width of first inside yoke 16*a* is larger than the outer width of first outside yoke 14*a*, and the outer width of second inside yoke 16*b* is larger than the outer width of second outside yoke 14*b*, whereby the drive force can be exerted on either side in the above-noted width direction and thereafter effectively exerted in a direction away from movable contact 10 in the extending direction of movable contact 10, and therefore the arc can be extended longer. Thus, the arc-extinguishing performance of switch 1 can be further enhanced.

The effect above can be achieved both when forward current and when reverse current flows.

In order to ensure equivalent interruption performance in both current directions, it is preferable that the magnetic field distribution is plane-symmetric with respect to a plane passing through the center of movable contact 10 in the extending direction of movable contact 10 and parallel to the above-noted width direction.

In the present embodiment, only one permanent magnet 15 is disposed in one arc-extinguishing chamber. The required number of permanent magnets 15 is reduced whereby the manufacturing cost of switch 1 can be reduced. First inside yoke 16*a* and second inside yoke 16*b* are integrally formed whereby the number of components is reduced and the manufacturing cost of switch 1 can be reduced as well.

Since permanent magnet 15 is disposed at a position at a distance from between first fixed contact point 8*a* and first movable contact point 9*a* and from between second fixed contact point 8*b* and second movable contact point 9*b*, where an arc is generated, thermal demagnetization of permanent magnet 15 by heat of the arc can be suppressed. Since the entire permanent magnet 15 overlaps insulating plate 17 as viewed from the axial direction of drive shaft 11, the effect of heat of arc on permanent magnet 15 also can be suppressed. The arc-extinguishing performance of switch 1 thus can be kept for a long time.

In the present embodiment, since each of first inside yoke 16*a* and second inside yoke 16*b* is connected to drive shaft 11, a notch for preventing interference with movable contact 10 need not be provided in each of first inside yoke 16*a* and second inside yoke 16*b*.

Second Embodiment

The switch according to a second embodiment of the present invention will be described below.

The switch according to the second embodiment of the present invention differs from switch 1 in the first embodiment only in the shape of each of the first inside yoke and the second inside yoke, and a description of the configuration similar to that of switch 1 in the first embodiment is not repeated.

Figure 11:
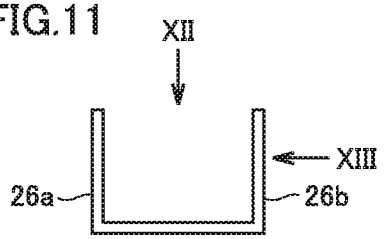
FIG. 11 is a diagram of the appearance of a member forming the inside yoke of the switch according to a second embodiment of the present invention as viewed from the side.
Figure 12:
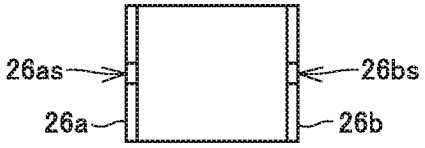
FIG. 12 is a view of the member forming the inside yoke in FIG. 11 as viewed from the direction of arrow XII.
Figure 13:
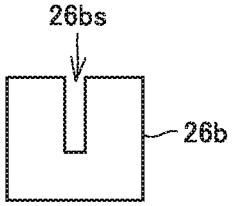
FIG. 13 is a view of the member forming the inside yoke in FIG. 11 as viewed from the direction of arrow XIII.

FIG. 11 is a view of the appearance of a member forming the inside yoke of the switch according to the second embodiment of the present invention as viewed from the side. FIG. 12 is a view of the member forming the inside yoke in FIG. 11 as viewed from the direction of arrow XII. FIG. 13 is a view of the member forming the inside yoke in FIG. 11 as viewed from the direction of arrow XIII.

As shown in FIG. 11 to FIG. 13, in the switch according to the second embodiment of the present invention, a first inside yoke 26*a* has a notch portion 26*as* extending in the above-noted axial direction at a center portion in the above-noted width direction. A second inside yoke 26*b* has a notch portion 26*bs* extending in the above-noted axial direction at a center portion in the above-noted width direction. Notch portion 26*as* and notch portion 26*bs* have approximately the same shape and are open on the movable contact 10 side.

Since notch portion 26*as* is provided in first inside yoke 26*a*, converging of the magnetic flux produced between first outside yoke 14*a* and first inside yoke 26*a* near the center portion of first inside yoke 26*a* in the above-noted width direction can be reduced, and the magnetic flux distribution can be expanded in the above-noted width direction.

Similarly, since notch portion 26*bs* is provided in second inside yoke 26*b*, converging of the magnetic flux produced between second outside yoke 14*b* and second inside yoke 26*b* near the center portion of second inside yoke 26*b* in the above-noted width direction can be reduced, and the magnetic flux distribution can be expanded in the above-noted width direction.

Thus, the drive force can be exerted more effectively on the arc in a direction away from movable contact 10 in the extending direction of movable contact 10. As a result, the drive force can be effectively exerted on the arc, and the arc-extinguishing performance of the switch can be enhanced.

When the width of each of notch portion 26*as* and notch portion 26*bs* is larger than the width of movable contact 10, first inside yoke 26*a* and second inside yoke 26*b* may be connected to the peripheral surface of the opening of base 12*b*, rather than being connected to drive shaft 11. In this case, an opening through which drive shaft 11 passes is provided at the connection portion connecting first inside yoke 26*a* and second inside yoke 26*b*.

Also in the present embodiment, permanent magnet 15 magnetically couples first outside yoke 14*a*, second outside yoke 14*b*, first inside yoke 26*a*, and second inside yoke 26*b*, and produces a magnetic field component in a direction along the extending direction of movable contact 10 between first fixed contact point 8*a* and first movable contact point 9*a* and between second fixed contact point 8*b* and second movable contact point 9*b*. As a result, the drive force can be effectively exerted on the arc, and the arc-extinguishing performance of the switch can be enhanced.

Third Embodiment

The switch according to a third embodiment of the present invention will be described below.

The switch according to the third embodiment of the present invention differs from switch 1 in the first embodiment mainly in the configuration of the permanent magnet, the first outside yoke, the second outside yoke, the first inside yoke, and the second inside yoke, and a description of the configuration similar to that of switch 1 in the first embodiment is not repeated.

Figure 14:
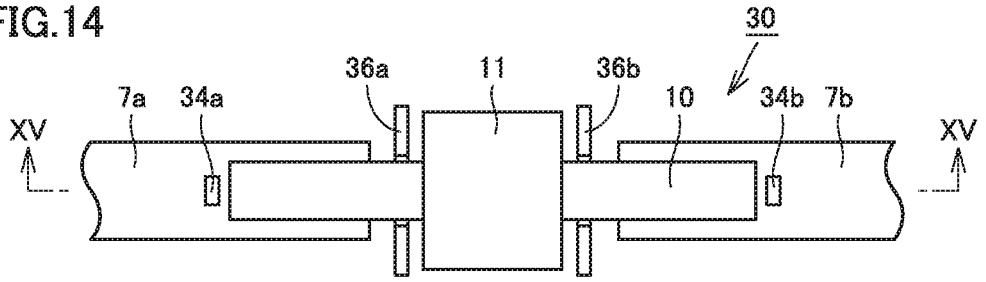
FIG. 14 is a partial enlarged view of the switch according to a third embodiment of the present invention with the arc cover removed as viewed from the front side.
Figure 15:
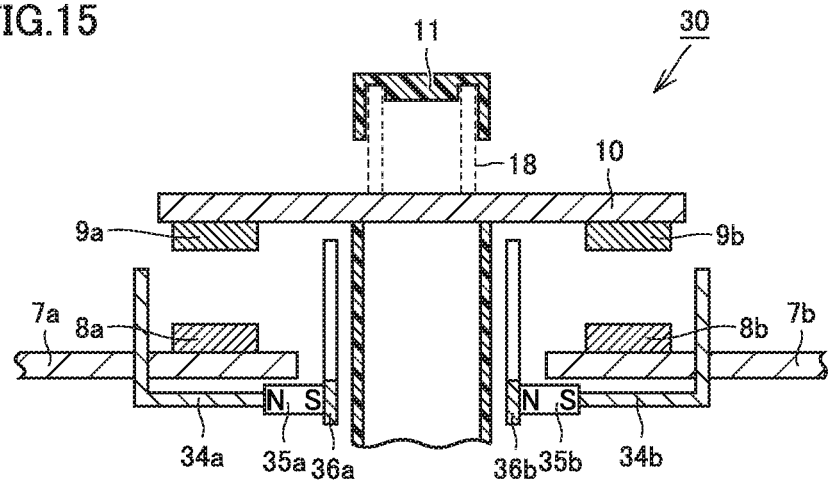
FIG. 15 is a cross-sectional view as viewed from the direction of arrows XV-XV in FIG. 14.

FIG. 14 is a partial enlarged view of the switch according to the third embodiment of the present invention with the arc cover removed as viewed from the front side. FIG. 15 is a cross-sectional view as viewed from the direction of arrows XV-XV in FIG. 14.

As shown in FIG. 14 and FIG. 15, switch 30 according to the third embodiment of the present invention includes a first fixed contact 7*a*, a second fixed contact 7*b*, a movable contact 10, a drive shaft 11, a first outside yoke 34*a*, a second outside yoke 34*b*, a first inside yoke 36*a*, a second inside yoke 36*b*, a first permanent magnet 35*a*, and a second permanent magnet 35*b*.

First permanent magnet 35*a* and second permanent magnet 35*b* are provided at a position on the opposite side to movable contact 10 in the axial direction of drive shaft 11 with respect to first fixed contact 7*a* and second fixed contact 7*b*. In the present embodiment, switch 30 includes two permanent magnets in each arc-extinguishing chamber.

First outside yoke 34*a* is formed of a magnetic substance such as iron, for example. First outside yoke 34*a* has an insulation coating. One end of first outside yoke 34*a* is connected to the north pole of first permanent magnet 35*a*. The other end of first outside yoke 34*a* is located in the vicinity of first fixed contact point 8*a* and first movable contact point 9*a*.

In the present embodiment, first outside yoke 34*a* has a portion extending in a direction along the extending direction of movable contact 10 and a portion extending in a direction along the axial direction of drive shaft 11. The portion extending in a direction along the extending direction of movable contact 10 in first outside yoke 34*a* faces the other main surface of movable contact 10 with a spacing therefrom. The portion extending in a direction along the axial direction of drive shaft 11 in first outside yoke 34*a* passes through a center portion of first fixed contact 7*a* in the above-noted width direction.

The shape of first outside yoke 34*a* is not limited to the shape described above as long as a part of first outside yoke 34*a* is located at a position outside one end portion of movable contact 10 in a direction along the extending direction of movable contact 10 as viewed from the axial direction of drive shaft 11, within a range in which a magnetic field component described later can be produced.

Second outside yoke 34*b* is formed of a magnetic substance such as iron, for example. Second outside yoke 34*b* has an insulation coating. One end of second outside yoke 34*b* is connected to the south pole of second permanent magnet 35*b*. The other end of second outside yoke 34*b* is located in the vicinity of second fixed contact point 8*b* and second movable contact point 9*b*.

In the present embodiment, second outside yoke 34*b* has a portion extending in a direction along the extending direction of movable contact 10 and a portion extending in a direction along the axial direction of drive shaft 11. The portion extending in a direction along the extending direction of movable contact 10 in second outside yoke 34*b* faces the other main surface of movable contact 10 with a spacing therefrom. The portion extending in a direction along the axial direction of drive shaft 11 in second outside yoke 34*b* passes through a center portion of second fixed contact 7*b* in the above-noted width direction.

The shape of second outside yoke 34*b* is not limited to the shape described above as long as a part of second outside yoke 34*b* is located at a position outside the other end portion of movable contact 10 in a direction along the extending direction of movable contact 10 as viewed from the axial direction of drive shaft 11, within a range in which a magnetic field component described later can be produced.

Figure 16:
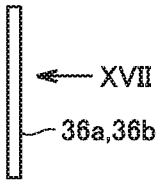
FIG. 16 is a view of the appearance of a member forming the inside yoke of the switch according to the third embodiment of the present invention as viewed from the side.
Figure 17:
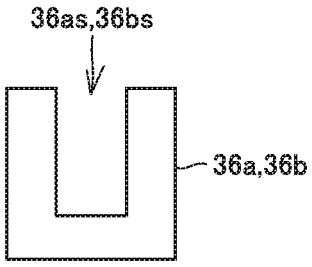
FIG. 17 is a view of the member forming the inside yoke in FIG. 16 as viewed from the direction of arrow XVII.

FIG. 16 is a view of the appearance of a member forming the inside yoke of the switch according to the third embodiment of the present invention as viewed from the side. FIG. 17 is a view of the member forming the inside yoke in FIG. 16 as viewed from the direction of arrow XVII.

As shown in FIG. 16 and FIG. 17, in the present embodiment, first inside yoke 36*a* and second inside yoke 36*b* are configured as separate parts. Each of first inside yoke 36*a* and second inside yoke 36*b* is formed of a sheet of magnetic substance such as iron. Each of first inside yoke 36*a* and second inside yoke 36*b* has a rectangular outer shape. Each of first inside yoke 36*a* and second inside yoke 36*b* has an insulation coating.

First inside yoke 36*a* has a notch portion 36*as* extending in the above-noted axial direction at a center portion in the above-noted width direction. Second inside yoke 36*b* has a notch portion 36*bs* extending in the above-noted axial direction at a center portion in the above-noted width direction. Notch portion 36*as* and notch portion 36*bs* have approximately the same shape and are open on the movable contact 10 side. The width of each of notch portion 36*as* and notch portion 36*bs* is larger than the width of movable contact 10. This can prevent each of first inside yoke 36*a* and second inside yoke 36*b* from interfering with movable contact 10.

One end portion of first inside yoke 36*a* is connected to the south pole of first permanent magnet 35*a*. One end portion of second inside yoke 36*b* is connected to the north pole of second permanent magnet 35*b*. The orientation of magnetic poles of each of first permanent magnet 35*a* and second permanent magnet 35*b* may be reversed. For example, one end portion of first inside yoke 36*a* may be connected to the north pole of first permanent magnet 35*a*, and one end portion of second inside yoke 36*b* may be connected to the south pole of second permanent magnet 35*b*. If the orientation of magnetic poles is changed, the arc driving direction described later is changed but the arc driving ability and the resulting interruption performance are equivalent.

First inside yoke 36*a* is located at a position between first fixed contact 7*a* and drive shaft 11 as viewed from the axial direction of drive shaft 11. Second inside yoke 36*b* is located at a position between second fixed contact 7*b* and drive shaft 11 as viewed from the axial direction of drive shaft 11.

In the present embodiment, a part of first outside yoke 34*a* and a part of first inside yoke 36*a* face each other between first fixed contact point 8*a* and first movable contact point 9*a*, as viewed from a direction along the extending direction of movable contact 10. The outer width of first inside yoke 36*a* is larger than the outer width of first outside yoke 34*a* in the above-noted width direction.

Although first outside yoke 34*a* and first inside yoke 36*a* do not necessarily face each other, it is preferable that a part of first outside yoke 34*a* and a part of first inside yoke 36*a* are located between first fixed contact point 8*a* and first movable contact point 9*a* as viewed from a direction along the extending direction of movable contact 10, in terms of producing a magnetic field component described later. The outer width of first inside yoke 36*a* may be equivalent to the outer width of first outside yoke 34*a*.

In the present embodiment, a part of second outside yoke 34*b* and a part of second inside yoke 36*b* face each other between second fixed contact point 8*b* and second movable contact point 9*b*, as viewed from a direction along the extending direction of movable contact 10. The outer width of second inside yoke 36*b* is larger than the outer width of second outside yoke 34*b* in the above-noted width direction.

Although second outside yoke 34*b* and second inside yoke 36*b* do not necessarily face each other, it is preferable that a part of second outside yoke 34*b* and a part of second inside yoke 36*b* are located between second fixed contact point 8*b* and second movable contact point 9*b* as viewed from a direction along the extending direction of movable contact 10, in terms of producing a magnetic field component described later. The outer width of second inside yoke 36*b* may be equivalent to the outer width of second outside yoke 34*b*.

Figure 18:
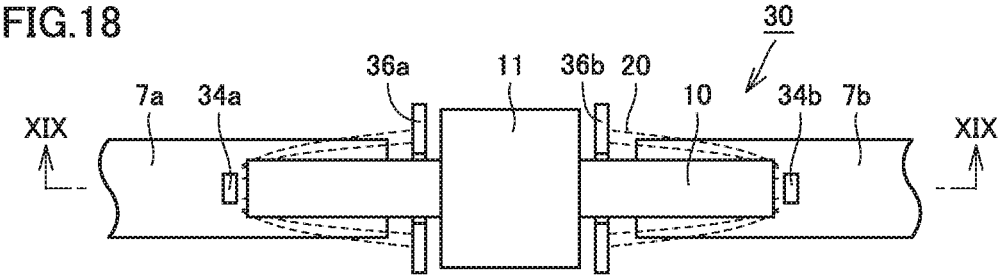
FIG. 18 is a partial enlarged view schematically showing the produced magnetic field distribution, as viewed from the front side of the switch according to the third embodiment of the present invention with the arc cover removed.
Figure 19:
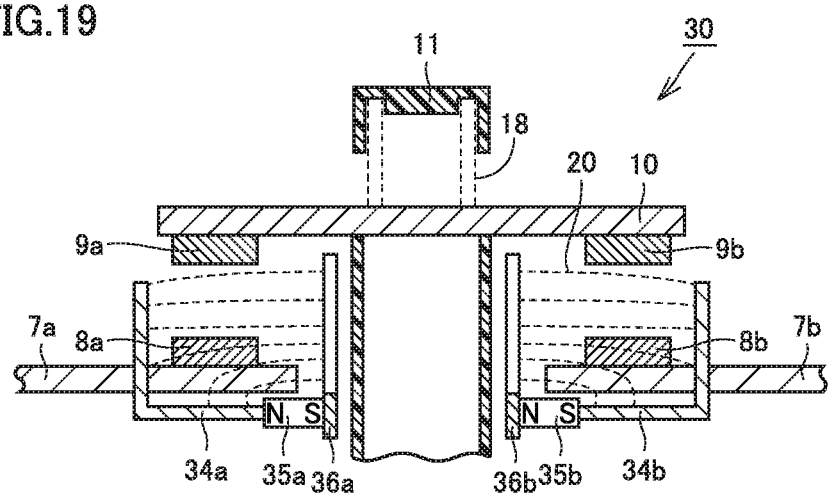
FIG. 19 is a cross-sectional view as viewed from the direction of arrows XIX-XIX in FIG. 18.

A magnetic field produced by first permanent magnet 35*a* and second permanent magnet 35*b* in switch 30 according to the third embodiment of the present invention will now be described. FIG. 18 is a partial enlarged view schematically showing the produced magnetic field distribution as viewed from the front side of the switch according to the third embodiment of the present invention with the arc cover removed. FIG. 19 is a cross-sectional view as viewed from the direction of arrows XIX-XIX in FIG. 18.

As shown in FIG. 18 and FIG. 19, magnetic flux 20 is distributed in a closed loop shape emitted from the north pole of first permanent magnet 35*a* toward the south pole of second permanent magnet 35*b*. Magnetic flux 20 intensively passes through first outside yoke 34*a*, first inside yoke 36*a*, second inside yoke 36*b*, and second outside yoke 34*b* which are formed of a magnetic substance having the property of allowing magnetic flux to easily pass through in the air. That is, first permanent magnet 35*a* and second permanent magnet 35*b* magnetically couple first outside yoke 14*a*, second outside yoke 14*b*, first inside yoke 16*a*, and second inside yoke 16*b*.

As a result, first permanent magnet 35*a* and second permanent magnet 35*b* produce a magnetic field component in a direction along the extending direction of movable contact 10 between first fixed contact point 8*a* and first movable contact point 9*a* and between second fixed contact point 8*b* and second movable contact point 9*b*.

In the present embodiment, as shown in FIG. 18, since the outer width of first inside yoke 36*a* is larger than outer width of first outside yoke 34*a*, magnetic flux 20 is distributed so as to expand in the above-noted width direction in the vicinity of first inside yoke 36*a* and to converge in the vicinity of first outside yoke 34*a*. Similarly, since the outer width of second inside yoke 36*b* is larger than the outer width of second outside yoke 34*b*, magnetic flux 20 is distributed so as to expand in the above-noted width direction in the vicinity of second inside yoke 36*b* and to converge in the vicinity of second outside yoke 34*b*.

Figure 20:
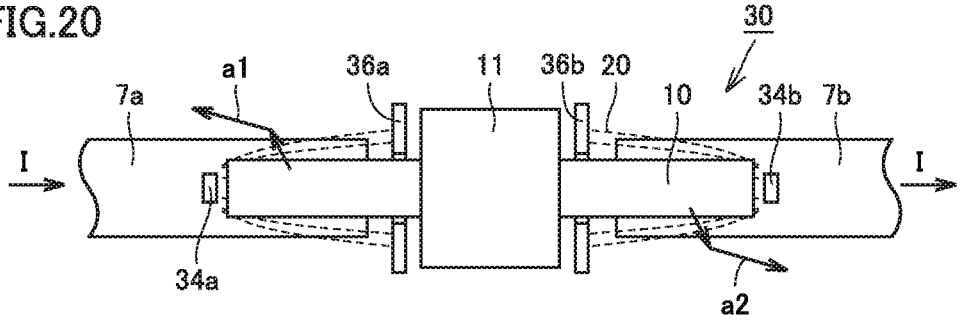
FIG. 20 is a partial enlarged view schematically showing a drive force acting on an arc produced when forward current flows, as viewed from the front side of the switch according to the third embodiment of the present invention with the arc cover removed.

FIG. 20 is a partial enlarged view schematically showing a drive force acting on an arc produced when forward current flows, as viewed from the front side of the switch according to the third embodiment of the present invention with the arc cover removed.

As shown in FIG. 20, when forward current flows, according to Fleming's rule, drive force a1 acts on the arc produced between first fixed contact point 8*a* and first movable contact point 9*a*, and drive force a2 acts on the arc produced between second fixed contact point 8*b* and second movable contact point 9*b*.

For the arc produced between first fixed contact point 8*a* and first movable contact point 9*a*, drive force a1 mainly acts on one side in the above-noted width direction and thereafter mainly acts in a direction away from movable contact 10 in the extending direction of movable contact 10. As a result, the arc produced between first fixed contact point 8*a* and first movable contact point 9*a* is extended long under the action of drive force a1.

Similarly, for the arc produced between second fixed contact point 8*b* and second movable contact point 9*b*, drive force a2 mainly acts on the other side in the above-noted width direction and thereafter mainly acts in a direction away from movable contact 10 in the extending direction of movable contact 10. As a result, the arc produced between second fixed contact point 8*b* and second movable contact point 9*b* is extended long under the action of drive force a2.

Figure 21:
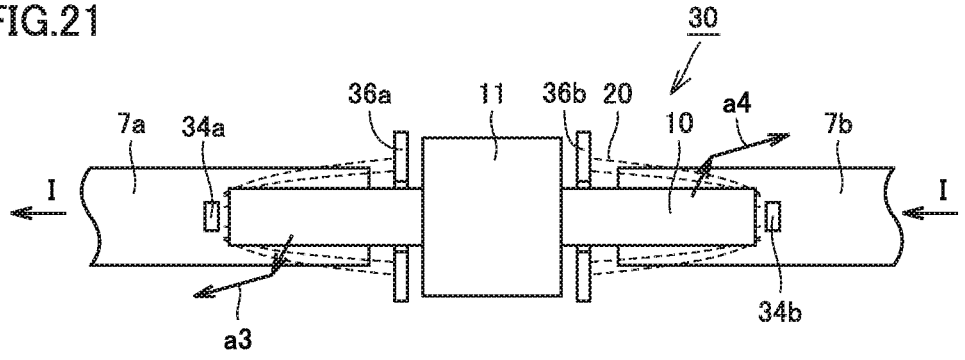
FIG. 21 is a partial enlarged view schematically showing a drive force acting on an arc produced when reverse current flows, as viewed from the front side of the switch according to the third embodiment of the present invention with the arc cover removed.

FIG. 21 is a partial enlarged view schematically showing a drive force acting on an arc produced when reverse current flows, as viewed from the front side of the switch according to the third embodiment of the present invention with the arc cover removed.

As shown in FIG. 21, when reverse current flows, according to Fleming's rule, drive force a3 acts on the arc produced between first fixed contact point 8*a* and first movable contact point 9*a*, and drive force a4 acts on the arc produced between second fixed contact point 8*b* and second movable contact point 9*b*.

For the arc produced between first fixed contact point 8*a* and first movable contact point 9*a*, drive force a3 mainly acts on the other side in the above-noted width direction and thereafter mainly acts in a direction away from movable contact 10 in the extending direction of movable contact 10. As a result, the arc produced between first fixed contact point 8*a* and first movable contact point 9*a* is extended long under the action of drive force a3.

Similarly, for the arc produced between second fixed contact point 8*b* and second movable contact point 9*b*, drive force a4 mainly acts on one side in the above-noted width direction and thereafter mainly acts in a direction away from movable contact 10 in the extending direction of movable contact 10. As a result, the arc produced between second fixed contact point 8*b* and second movable contact point 9*b* is extended long under the action of drive force a4.

As described above, in switch 30 according to the third embodiment of the present invention, both when forward current flows and when reverse current flows, the drive force can be exerted on the arc on either side in the above-noted width direction and thereafter exerted in a direction away from movable contact 10 in the extending direction of movable contact 10.

Also in switch 30 according to the third embodiment of the present invention, first permanent magnet 35*a* and second permanent magnet 35*b* magnetically couple first outside yoke 34*a*, second outside yoke 34*b*, first inside yoke 36*a*, and second inside yoke 36*b*, and produce a magnetic field component in a direction along the extending direction of movable contact 10 between first fixed contact point 8*a* and first movable contact point 9*a* and between second fixed contact point 8*b* and second movable contact point 9*b*. As a result, the drive force can be effectively exerted on the arc, and the arc-extinguishing performance of switch 30 can be enhanced.

Both when forward current flows and when reverse current flows, the drive force can be exerted on the arc on either side in the above-noted width direction and thereafter exerted in a direction away from movable contact 10 in the extending direction of movable contact 10. As a result, the arc-extinguishing performance of switch 30 can be more enhanced irrespective of the direction current flows.

In particular, in the above-noted width direction, the outer width of first inside yoke 36*a* is larger than the outer width of first outside yoke 34*a*, and the outer width of second inside yoke 36*b* is larger than the outer width of second outside yoke 34*b*, whereby the drive force can be exerted on either side in the above-noted width direction and thereafter effectively exerted in a direction away from movable contact 10 in the extending direction of movable contact 10, and therefore the arc can be extended longer. Thus, the arc-extinguishing performance of switch 30 can be further enhanced.

Since notch portion 36*as* is provided in first inside yoke 36*a*, converging of the magnetic flux produced between first outside yoke 34*a* and first inside yoke 36*a* near the center portion of first inside yoke 36*a* in the above-noted width direction can be reduced, and the magnetic flux distribution can be expanded in the above-noted width direction.

Similarly, since notch portion 36*bs* is provided in second inside yoke 36*b*, converging of the magnetic flux produced between second outside yoke 34*b* and second inside yoke 36*b* near the center portion of second inside yoke 36*b* in the above-noted width direction can be reduced, and the magnetic flux distribution can be expanded in the above-noted width direction.

Thus, the drive force can be exerted more effectively on the arc in a direction away from movable contact 10 in the extending direction of movable contact 10. As a result, the drive force can be effectively exerted on the arc, and the arc-extinguishing performance of the switch can be enhanced.

In the present embodiment, since first inside yoke 36*a* is connected to first permanent magnet 35*a* and second inside yoke 36*b* is connected to second permanent magnet 35*b*, the magnetic gap between the inside yoke and the permanent magnet is smaller and therefore a stronger drive force can be exerted on the arc. Thus, the arc-extinguishing performance of switch 30 can be enhanced. When the strength of drive force is kept, the size of the permanent magnet can be reduced, and the cost per permanent magnet can be reduced.

Each of first outside yoke 34*a* and first inside yoke 36*a* has an insulation coating, whereby short-circuiting between first fixed contact 7*a* and movable contact 10 can be suppressed. Each of second outside yoke 34*b* and second inside yoke 36*b* has an insulation coating, whereby short-circuiting between second fixed contact 7*b* and movable contact 10 can be suppressed.

Fourth Embodiment

The switch according to a fourth embodiment of the present invention will be described below.

The switch according to the fourth embodiment of the present invention differs from switch 1 in the first embodiment mainly in the configuration of the permanent magnet, the first outside yoke, the second outside yoke, the first inside yoke, and the second inside yoke, and a description of the configuration similar to that of switch 1 in the first embodiment is not repeated.

Figure 22:
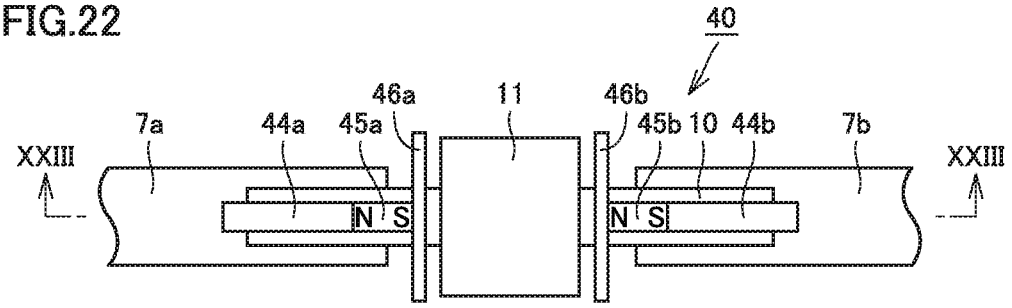
FIG. 22 is a partial enlarged view of the switch according to a fourth embodiment of the present invention with the arc cover removed as viewed from the front side.
Figure 23:
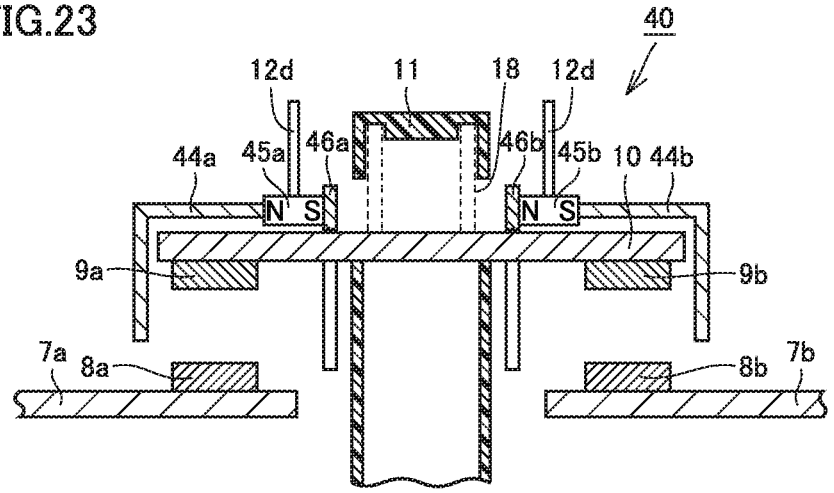
FIG. 23 is a cross-sectional view as viewed from the direction of arrows XXIII-XXIII in FIG. 22.

FIG. 22 is a partial enlarged view of the switch according to the fourth embodiment of the present invention with the arc cover removed as viewed from the front side. FIG. 23 is a cross-sectional view as viewed from the direction of arrows XXIII-XXIII in FIG. 22.

As shown in FIG. 22 and FIG. 23, switch 40 according to the fourth embodiment of the present invention includes a first fixed contact 7*a*, a second fixed contact 7*b*, a movable contact 10, a drive shaft 11, a first outside yoke 44*a*, a second outside yoke 44*b*, a first inside yoke 46*a*, a second inside yoke 46*b*, a first permanent magnet 45*a*, and a second permanent magnet 45*b*.

First permanent magnet 45*a* and second permanent magnet 45*b* are provided at a position on the opposite side to first fixed contact 7*a* and second fixed contact 7*b* in the axial direction of drive shaft 11 with respect to movable contact 10. In the present embodiment, switch 40 includes two permanent magnets in each arc-extinguishing chamber.

A support 12*d* is attached to each of first permanent magnet 45*a* and second permanent magnet 45*b*. Each of first permanent magnet 45*a* and second permanent magnet 45*b* is fixed to the arc cover by support 12*d*.

First outside yoke 44*a* is formed of a magnetic substance such as iron, for example. One end of first outside yoke 44*a* is connected to the north pole of first permanent magnet 45*a*. The other end of first outside yoke 44*a* is located in the vicinity of first fixed contact point 8*a* and first movable contact point 9*a*.

In the present embodiment, first outside yoke 44*a* has a portion extending in a direction along the extending direction of movable contact 10 and a portion extending in a direction along the axial direction of drive shaft 11. The portion extending in a direction along the extending direction of movable contact 10 in first outside yoke 44*a* faces one main surface of movable contact 10 with a spacing therefrom. The portion extending in a direction along the axial direction of drive shaft 11 in first outside yoke 44*a* faces one end surface of movable contact 10 with a spacing therefrom.

The shape of first outside yoke 44*a* is not limited to the shape described above as long as a part of first outside yoke 44*a* is located at a position outside one end portion of movable contact 10 in a direction along the extending direction of movable contact 10 as viewed from the axial direction of drive shaft 11, within a range in which a magnetic field component described later can be produced.

Second outside yoke 44*b* is formed of a magnetic substance such as iron, for example. One end of second outside yoke 44*b* is connected to the south pole of second permanent magnet 45*b*. The other end of second outside yoke 44*b* is located in the vicinity of second fixed contact point 8*b* and second movable contact point 9*b*.

In the present embodiment, second outside yoke 44*b* has a portion extending in a direction along the extending direction of movable contact 10 and a portion extending in a direction along the axial direction of drive shaft 11. The portion extending in a direction along the extending direction of movable contact 10 in second outside yoke 34*b* faces one main surface of movable contact 10 with a spacing therefrom. The portion extending in a direction along the axial direction of drive shaft 11 in second outside yoke 44*b* faces the other end surface of movable contact 10 with a spacing therefrom.

The shape of second outside yoke 44*b* is not limited to the shape described above as long as a part of second outside yoke 44*b* is located at a position outside the other end portion of movable contact 10 in a direction along the extending direction of movable contact 10 as viewed from the axial direction of drive shaft 11, within a range in which a magnetic field component described later can be produced.

Figure 24:
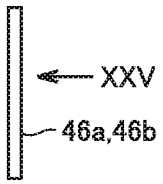
FIG. 24 is a view of the appearance of a member forming the inside yoke of the switch according to the fourth embodiment of the present invention as viewed from the side.
Figure 25:
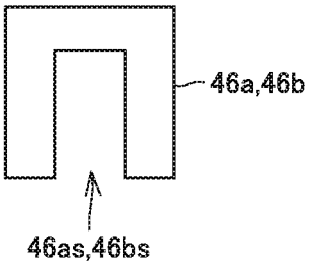
FIG. 25 is a view of the member forming the inside yoke in FIG. 24 as viewed from the direction of arrow XXV.

FIG. 24 is a view of the appearance of a member forming the inside yoke of the switch according to the fourth embodiment of the present invention as viewed from the side. FIG. 25 is a view of the member forming the inside yoke in FIG. 24 as viewed from the direction of arrow XXV.

As shown in FIG. 24 and FIG. 25, in the present embodiment, first inside yoke 46*a* and second inside yoke 46*b* are configured as separate parts. Each of first inside yoke 46*a* and second inside yoke 46*b* is formed of a sheet of magnetic substance such as iron. Each of first inside yoke 46*a* and second inside yoke 46*b* has a rectangular outer shape.

First inside yoke 46*a* has a notch portion 46*as* extending in the above-noted axial direction at a center portion in the above-noted width direction. Second inside yoke 46*b* has a notch portion 46*bs* extending in the above-noted axial direction at a center portion in the above-noted width direction. Notch portion 46*as* and notch portion 46*bs* have approximately the same shape and are open on the movable contact 10 side. The width of each of notch portion 46*as* and notch portion 46*bs* is larger than the width of movable contact 10. This can prevent each of first inside yoke 46*a* and second inside yoke 46*b* from interfering with movable contact 10.

One end portion of first inside yoke 46*a* is connected to the south pole of first permanent magnet 45*a*. One end portion of second inside yoke 46*b* is connected to the north pole of second permanent magnet 45*b*. The orientation of magnetic poles of each of first permanent magnet 45*a* and second permanent magnet 45*b* may be reversed. For example, one end portion of first inside yoke 46*a* may be connected to the north pole of first permanent magnet 45*a*, and one end portion of second inside yoke 46*b* may be connected to the south pole of second permanent magnet 45*b*. If the orientation of magnetic poles is changed, the arc driving direction described later is changed but the arc driving ability and the resulting interruption performance are equivalent.

First inside yoke 46*a* is located at a position between first fixed contact 7*a* and drive shaft 11 as viewed from the axial direction of drive shaft 11. Second inside yoke 46*b* is located at a position between second fixed contact 7*b* and drive shaft 11 as viewed from the axial direction of drive shaft 11.

In the present embodiment, a part of first outside yoke 44*a* and a part of first inside yoke 46*a* face each other between first fixed contact point 8*a* and first movable contact point 9*a*, as viewed from a direction along the extending direction of movable contact 10. The outer width of first inside yoke 46*a* is larger than the outer width of first outside yoke 44*a* in the above-noted width direction.

Although first outside yoke 44*a* and first inside yoke 46*a* do not necessarily face each other, it is preferable that a part of first outside yoke 44*a* and a part of first inside yoke 46*a* are located between first fixed contact point 8*a* and first movable contact point 9*a* as viewed from a direction along the extending direction of movable contact 10, in terms of producing a magnetic field component described later. The outer width of first inside yoke 46*a* may be equivalent to the outer width of first outside yoke 44*a*.

In the present embodiment, a part of second outside yoke 44*b* and a part of second inside yoke 46*b* face each other between second fixed contact point 8*b* and second movable contact point 9*b*, as viewed from a direction along the extending direction of movable contact 10. The outer width of second inside yoke 46*b* is larger than the outer width of second outside yoke 44*b* in the above-noted width direction.

Although second outside yoke 44*b* and second inside yoke 46*b* do not necessarily face each other, it is preferable that a part of second outside yoke 44*b* and a part of second inside yoke 46*b* are located between second fixed contact point 8*b* and second movable contact point 9*b* as viewed from a direction along the extending direction of movable contact 10, in terms of producing a magnetic field component described later. The outer width of second inside yoke 46*b* may be equivalent to the outer width of second outside yoke 44*b*.

First permanent magnet 45*a* and second permanent magnet 45*b* magnetically couple first outside yoke 44*a*, second outside yoke 44*b*, first inside yoke 46*a*, and second inside yoke 46*b*. As a result, first permanent magnet 45*a* and second permanent magnet 45*b* produce a magnetic field component in a direction along the extending direction of movable contact 10 between first fixed contact point 8*a* and first movable contact point 9*a* and between second fixed contact point 8*b* and second movable contact point 9*b*.

Also in switch 40 according to the fourth embodiment of the present invention, first permanent magnet 45*a* and second permanent magnet 45*b* magnetically couple first outside yoke 44*a*, second outside yoke 44*b*, first inside yoke 46*a*, and second inside yoke 46*b*, and produce a magnetic field component in a direction along the extending direction of movable contact 10 between first fixed contact point 8*a* and first movable contact point 9*a* and between second fixed contact point 8*b* and second movable contact point 9*b*. As a result, the drive force can be effectively exerted on the arc, and the arc-extinguishing performance of switch 40 can be enhanced.

Both when forward current flows and when reverse current flows, the drive force can be exerted on the arc on either side in the above-noted width direction and thereafter exerted in a direction away from movable contact 10 in the extending direction of movable contact 10. As a result, the arc-extinguishing performance of switch 30 can be more enhanced irrespective of the direction current flows.

In particular, in the above-noted width direction, the outer width of first inside yoke 46*a* is larger than the outer width of first outside yoke 44*a*, and the outer width of second inside yoke 46*b* is larger than the outer width of second outside yoke 44*b*, whereby the drive force can be exerted on either side in the above-noted width direction and thereafter effectively exerted in a direction away from movable contact 10 in the extending direction of movable contact 10, and therefore the arc can be extended longer. Thus, the arc-extinguishing performance of switch 40 can be further enhanced.

Since notch portion 46*as* is provided in first inside yoke 46*a*, converging of the magnetic flux produced between first outside yoke 44*a* and first inside yoke 46*a* near the center portion of first inside yoke 46*a* in the above-noted width direction can be reduced, and the magnetic flux distribution can be expanded in the above-noted width direction.

Similarly, since notch portion 46*bs* is provided in second inside yoke 46*b*, converging of the magnetic flux produced between second outside yoke 44*b* and second inside yoke 46*b* near the center portion of second inside yoke 46*b* in the above-noted width direction can be reduced, and the magnetic flux distribution can be expanded in the above-noted width direction.

Thus, the drive force can be exerted more effectively on the arc in a direction away from movable contact 10 in the extending direction of movable contact 10. As a result, the drive force can be effectively exerted on the arc, and the arc-extinguishing performance of the switch can be enhanced.

In the present embodiment, since first inside yoke 46*a* is connected to first permanent magnet 45*a* and second inside yoke 46*b* is connected to second permanent magnet 45*b*, the magnetic gap between the inside yoke and the permanent magnet is smaller and therefore a stronger drive force can be exerted on the arc. Thus, the arc-extinguishing performance of switch 40 can be enhanced. When the strength of drive force is kept, the size of the permanent magnet can be reduced and the cost per permanent magnet can be reduced.

Fifth Embodiment

The switch according to a fifth embodiment of the present invention will be described below.

The switch according to the fifth embodiment of the present invention differs from switch 40 in the fourth embodiment in the shape of each of the first outside yoke and the second outside yoke, and a description of the configuration similar to that of switch 40 in the fourth embodiment is not repeated.

Figure 26:
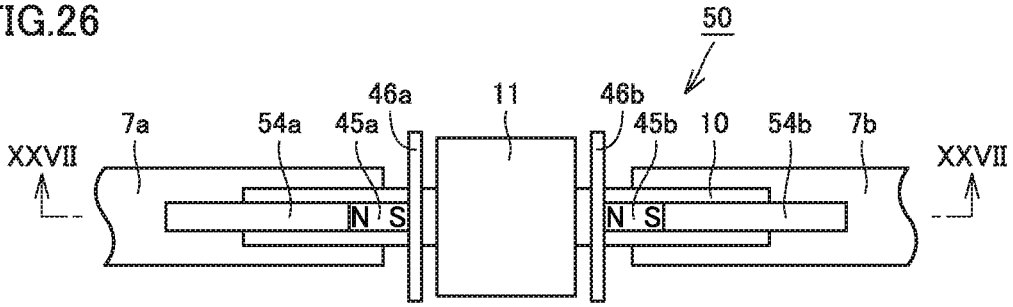
FIG. 26 is a partial enlarged view of the switch according to a fifth embodiment of the present invention with the arc cover removed as viewed from the front side.
Figure 27:
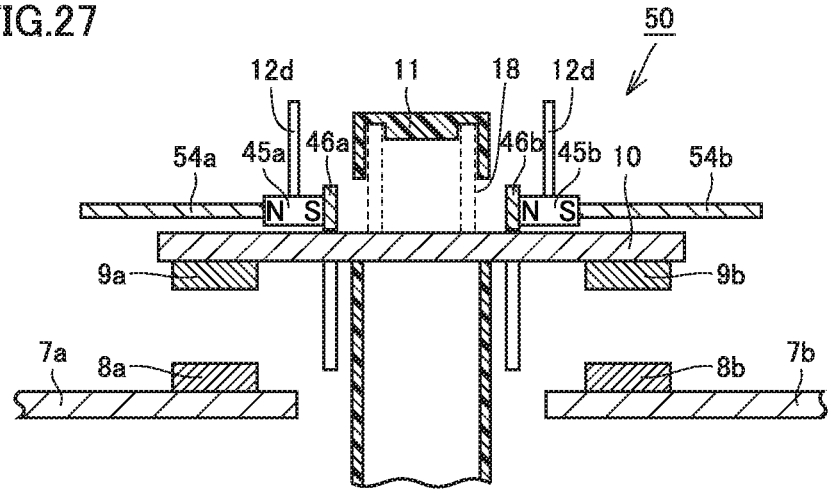
FIG. 27 is a cross-sectional view as viewed from the direction of arrows XXVII-XXVII in FIG. 26.

FIG. 26 is a partial enlarged view of the switch according to the fifth embodiment of the present invention with the arc cover removed as viewed from the front side. FIG. 27 is a cross-sectional view as viewed from the direction of arrows XXVII-XXVII in FIG. 26.

As shown in FIG. 26 and FIG. 27, switch 50 according to the fifth embodiment of the present invention includes a first fixed contact 7*a*, a second fixed contact 7*b*, a movable contact 10, a drive shaft 11, a first outside yoke 54*a*, a second outside yoke 54*b*, a first inside yoke 46*a*, a second inside yoke 46*b*, a first permanent magnet 45*a*, and a second permanent magnet 45*b*.

First outside yoke 54*a* is formed of a magnetic substance such as iron, for example. First outside yoke 54*a* extends in a direction along the extending direction of movable contact 10. First outside yoke 54*a* faces one main surface of movable contact 10 with a spacing therefrom. One end of first outside yoke 54*a* is connected to the north pole of first permanent magnet 45*a*. The orientation of magnetic poles may be reversed. The other end of first outside yoke 54*a* is located at a position outside one end portion of movable contact 10 in a direction along the extending direction of movable contact 10, as viewed from the axial direction of drive shaft 11.

Second outside yoke 54*b* is formed of a magnetic substance such as iron, for example. Second outside yoke 54*b* extends in a direction along the extending direction of movable contact 10. Second outside yoke 54*b* faces one main surface of movable contact 10 with a spacing therefrom. One end of second outside yoke 54*b* is connected to the south pole of second permanent magnet 45*b*. The orientation of magnetic poles may be reversed. The other end of second outside yoke 54*b* is located at a position outside the other end portion of movable contact 10 in a direction along the extending direction of movable contact 10, as viewed from the axial direction of drive shaft 11.

First permanent magnet 45*a* and second permanent magnet 45*b* magnetically couple first outside yoke 54*a*, second outside yoke 54*b*, first inside yoke 46*a*, and second inside yoke 46*b*. As a result, first permanent magnet 45*a* and second permanent magnet 45*b* produce a magnetic field component in a direction along the extending direction of movable contact 10 between first fixed contact point 8*a* and first movable contact point 9*a* and between second fixed contact point 8*b* and second movable contact point 9*b*.

Also in switch 50 according to the fifth embodiment of the present invention, first permanent magnet 45*a* and second permanent magnet 45*b* magnetically couple first outside yoke 54*a*, second outside yoke 54*b*, first inside yoke 46*a*, and second inside yoke 46*b*, and produce a magnetic field component in a direction along the extending direction of movable contact 10 between first fixed contact point 8*a* and first movable contact point 9*a* and between second fixed contact point 8*b* and second movable contact point 9*b*. As a result, the drive force can be effectively exerted on the arc, and the arc-extinguishing performance of switch 50 can be enhanced.

In the present embodiment, each of first outside yoke 54*a* and second outside yoke 54*b* can be formed in a simple shape. In addition, damage of first outside yoke 54*a* and second outside yoke 54*b* due to coming into contact with the arc can be suppressed.

Sixth Embodiment

The switch according to a sixth embodiment of the present invention will be described below.

The switch according to the sixth embodiment of the present invention differs from switch 30 in the third embodiment in the shape of each of the first fixed contact and the second fixed contact, and a description of the configuration similar to that of switch 30 in the third embodiment is not repeated.

Figure 28:
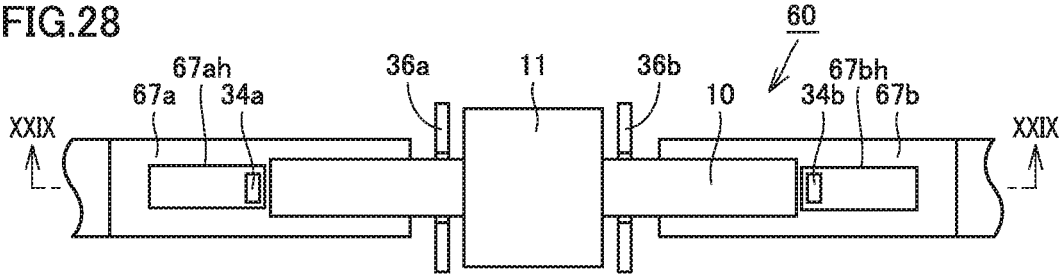
FIG. 28 is a partial enlarged view of the switch according to a sixth embodiment of the present invention with the arc cover removed as viewed from the front side.
Figure 29:
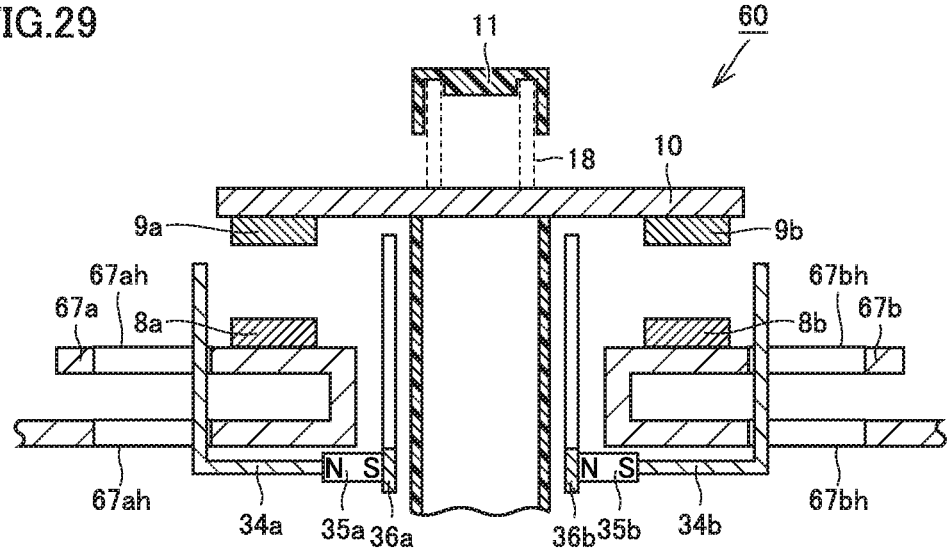
FIG. 29 is a cross-sectional view as viewed from the direction of arrows XXIX-XXIX in FIG. 28.

FIG. 28 is a partial enlarged view of the switch according to the sixth embodiment of the present invention with the arc cover removed as viewed from the front side. FIG. 29 is a cross-sectional view as viewed from the direction of arrows XXIX-XXIX in FIG. 28.

As shown in FIG. 28 and FIG. 29, switch 60 according to the sixth embodiment of the present invention includes a first fixed contact 67*a*, a second fixed contact 67*b*, a movable contact 10, a drive shaft 11, a first outside yoke 34*a*, a second outside yoke 34*b*, a first inside yoke 36*a*, a second inside yoke 36*b*, a first permanent magnet 35*a*, and a second permanent magnet 35*b*.

First fixed contact 67*a* has a longitudinal direction and includes a portion extending in the longitudinal direction so as to approach drive shaft 11, a portion bending from this portion and extending along drive shaft 11 so as to approach movable contact 10, and a portion bending from this portion and extending in the longitudinal direction so as to depart from drive shaft 11. In each of the portion extending in the longitudinal direction so as to approach drive shaft 11 and the portion extending along drive shaft 11 so as to approach movable contact 10, a slot-shaped through hole 67*ah* extending in the longitudinal direction is provided at a center portion in the above-noted width direction to allow first outside yoke 34*a* to pass through.

Second fixed contact 67*b* is disposed to be aligned in a row with first fixed contact 67*a* with a spacing therefrom. Second fixed contact 67*b* has a longitudinal direction and includes a portion extending in the longitudinal direction so as to approach drive shaft 11, a portion bending from this portion and extending along drive shaft 11 so as to approach movable contact 10, and a portion bending from this portion and extending in the longitudinal direction so as to depart from drive shaft 11. In each of the portion extending in the longitudinal direction so as to approach drive shaft 11 and the portion extending along drive shaft 11 so as to approach movable contact 10, a slot-shaped through hole 67*bh* extending in the longitudinal direction is provided at a center portion in the above-noted width direction to allow second outside yoke 34*b* to pass through.

First fixed contact point 8*a* is provided on a main surface of the other end portion in the longitudinal direction of the portion of first fixed contact 67*a* that extends in the longitudinal direction so as to depart from drive shaft 11. Second fixed contact point 8*b* is provided on a main surface of one end portion in the longitudinal direction of the portion of second fixed contact 67*b* that extends in the longitudinal direction so as to depart from drive shaft 11. First fixed contact point 8*a* and second fixed contact point 8*b* are aligned in the longitudinal direction of each of first fixed contact 67*a* and second fixed contact 67*b*.

In the present embodiment, since each of first fixed contact 67*a* and second fixed contact 67*b* has a bent shape, the self-magnetic field by current flowing through each of first fixed contact 67*a* and second fixed contact 67*b* is intensified, thereby enhancing the drive force acting on the arc.

In the present embodiment, through hole 67*ah* is provided in first fixed contact 67*a*, and through hole 67*bh* is provided in second fixed contact 67*b*. Thus, the density of current flowing through each of first fixed contact 67*a* and second fixed contact 67*b* is increased. This can intensify the electromagnetic force acting on the arc running on first fixed contact 67*a* or on second fixed contact 67*b* to improve the arc-interruption performance. Since through hole 67*ah* is provided in first fixed contact 67*a* and through hole 67*bh* is provided in second fixed contact 67*b*, damage of each of first outside yoke 34*a* and second outside yoke 34*b* due to coming into contact with the arc can be suppressed.

Seventh Embodiment

The switch according to a seventh embodiment of the present invention will be described below.

The switch according to the seventh embodiment of the present invention differs from switch 60 in the sixth embodiment in that a depression is provided in the movable contact, and a description of the configuration similar to that of switch 60 in the sixth embodiment is not repeated.

Figure 30:
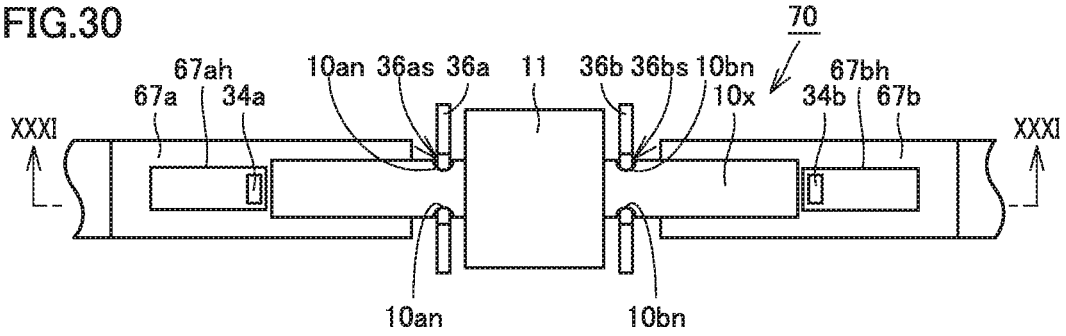
FIG. 30 is a partial enlarged view of the switch according to a seventh embodiment of the present invention with the arc cover removed as viewed from the front side.
Figure 31:
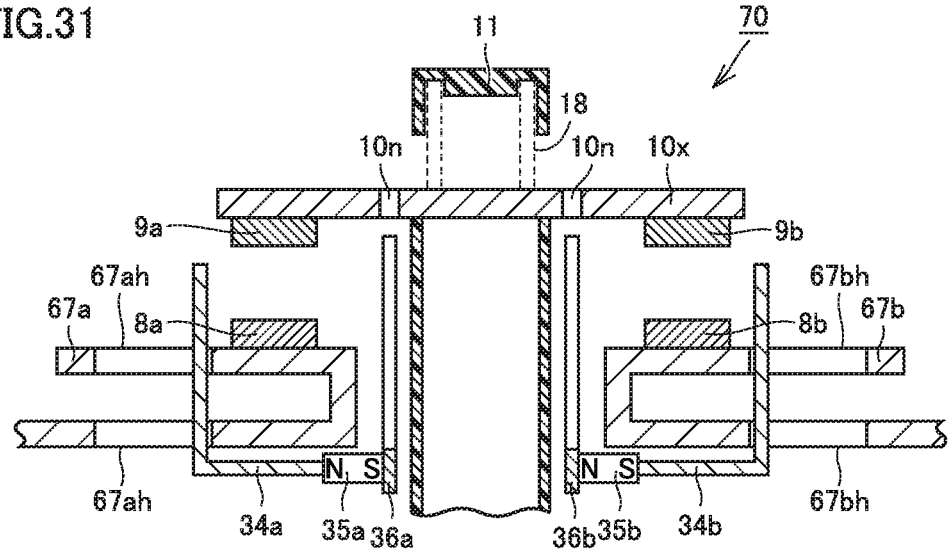
FIG. 31 is a cross-sectional view as viewed from the direction of arrows XXXI-XXXI in FIG. 30.

FIG. 30 is a partial enlarged view of the switch according to the seventh embodiment of the present invention with the arc cover removed as viewed from the front side. FIG. 31 is a cross-sectional view as viewed from the direction of arrows XXXI-XXXI in FIG. 30.

As shown in FIG. 30 and FIG. 31, switch 70 according to the seventh embodiment of the present invention includes a first fixed contact 67*a*, a second fixed contact 67*b*, a movable contact 10*x*, a drive shaft 11, a first outside yoke 34*a*, a second outside yoke 34*b*, a first inside yoke 36*a*, a second inside yoke 36*b*, a first permanent magnet 35*a*, and a second permanent magnet 35*b*.

Movable contact 10*x* has a depression 10*an* extending in the axial direction of drive shaft 11 at a position corresponding to notch portion 36*as* of first inside yoke 36*a* and a depression 10*bn* extending in the axial direction of drive shaft 11 at a position corresponding to notch portion 36*bs* of second inside yoke 36*b*, on both side surfaces vertical to the above-noted width direction.

In a switch, the movable contact may be displaced, for example, due to vibration. In the present embodiment, since depression 10*an* and depression 10*bn* are provided in movable contact 10*x*, the distance between each of first inside yoke 36*a* and second inside yoke 36*b* and movable contact 10*x* can be increased while the shape of each of first inside yoke 36*a* and second inside yoke 36*b* is kept. Thus, even when movable contact 10*x* is displaced, interference or contact of each of first inside yoke 36*a* and second inside yoke 36*b* with movable contact 10*x* can be suppressed while the drive force acting on the arc is kept.

Eighth Embodiment

The switch according to an eighth embodiment of the present invention will be described below.

The switch according to the eighth embodiment of the present invention differs from switch 60 in the sixth embodiment in that an arc-extinguishing material is provided in the vicinity of the movable contact point and the fixed contact point, and a description of the configuration similar to that of switch 60 in the sixth embodiment is not repeated.

Figure 32:
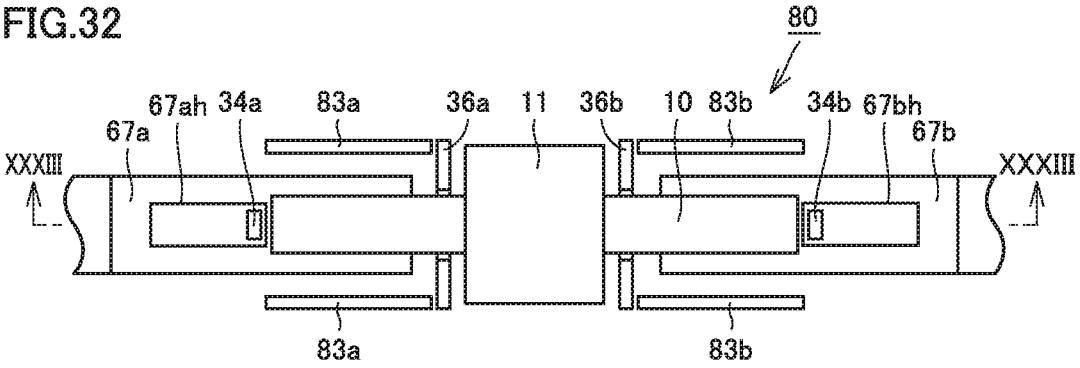
FIG. 32 is a partial enlarged view of the switch according to an eighth embodiment of the present invention with the arc cover removed as viewed from the front side.
Figure 33:
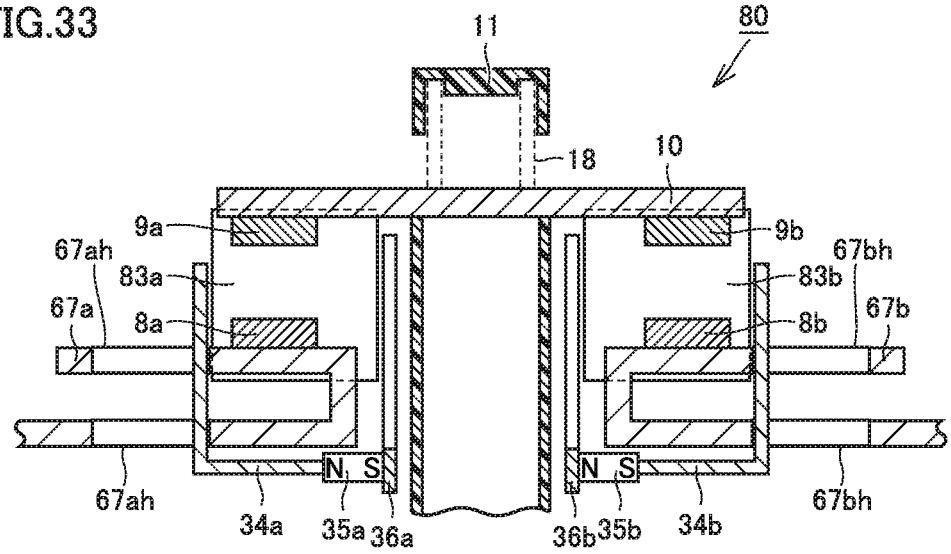
FIG. 33 is a cross-sectional view as viewed from the direction of arrows XXXIII-XXXIII in FIG. 32.

FIG. 32 is a partial enlarged view of the switch according to the eighth of the present invention with the arc cover removed as viewed from the front side. FIG. 33 is a cross-sectional view as viewed from the direction of arrows XXXIII-XXXIII in FIG. 32.

As shown in FIG. 32 and FIG. 33, switch 80 according to the eighth embodiment of the present invention includes a first fixed contact 67*a*, a second fixed contact 67*b*, a movable contact 10, a drive shaft 11, a first outside yoke 34*a*, a second outside yoke 34*b*, a first inside yoke 36*a*, a second inside yoke 36*b*, a first permanent magnet 35*a*, a second permanent magnet 35*b*, a first arc-extinguishing material 83*a*, and a second arc-extinguishing material 83*b*.

A pair of first arc-extinguishing materials 83*a* each have a flat plate-shaped outer shape and are disposed to face each other with a spacing therebetween in the above-noted width direction. First fixed contact point 8*a* and first movable contact point 9*a* are located between a pair of first arc-extinguishing materials 83*a*. First arc-extinguishing materials 83*a* are formed of an organic or inorganic insulating material or a metal material.

A pair of second arc-extinguishing materials 83*b* each have a flat plate-shaped outer shape and are disposed to face each other with a spacing therebetween in the above-noted width direction. Second fixed contact point 8*b* and second movable contact point 9*b* are located between a pair of second arc-extinguishing materials 83*b*. Second arc-extinguishing materials 83*b* are formed of an organic or inorganic insulating material or a metal material.

As shown in FIG. 20 and FIG. 21, each of the arc produced between first fixed contact point 8*a* and first movable contact point 9*a* and the arc produced between second fixed contact point 8*b* and second movable contact point 9*b* is driven in the above-noted width direction and thereafter driven in a direction away from movable contact 10 in the extending direction of movable contact 10.

In the present embodiment, since first arc-extinguishing materials 83*a* and second arc-extinguishing materials 83*b* are provided, the arc driven in the above-noted width direction comes into contact with first arc-extinguishing materials 83*a* or second arc-extinguishing materials 83*b*, whereby the arc can be attenuated in the initial state of opening of switch 80, the arc current can be limited, and the interruption reliability of switch 80 can be enhanced.

Ninth Embodiment

The switch according to a ninth embodiment of the present invention will be described below.

The switch according to the ninth embodiment of the present invention differs from switch 60 in the sixth embodiment in that a grid is provided in the vicinity of the movable contact point and the fixed contact point, and a description of the configuration similar to that of switch 60 in the sixth embodiment is not repeated.

Figure 34:
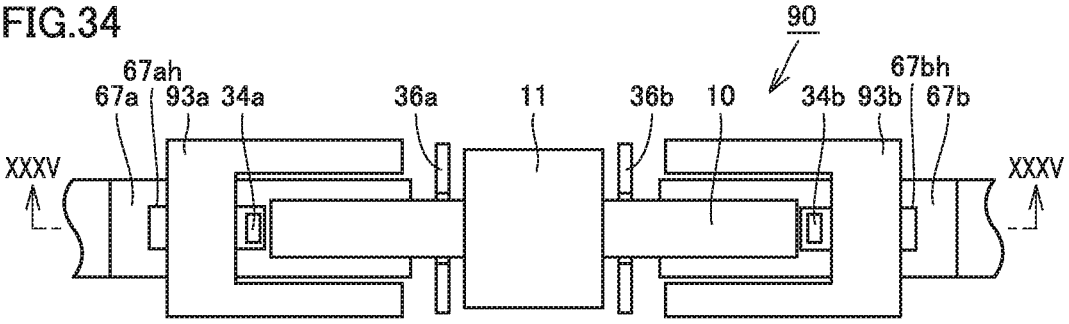
FIG. 34 is a partial enlarged view of the switch according to a ninth embodiment of the present invention with the arc cover removed as viewed from the front side.
Figure 35:
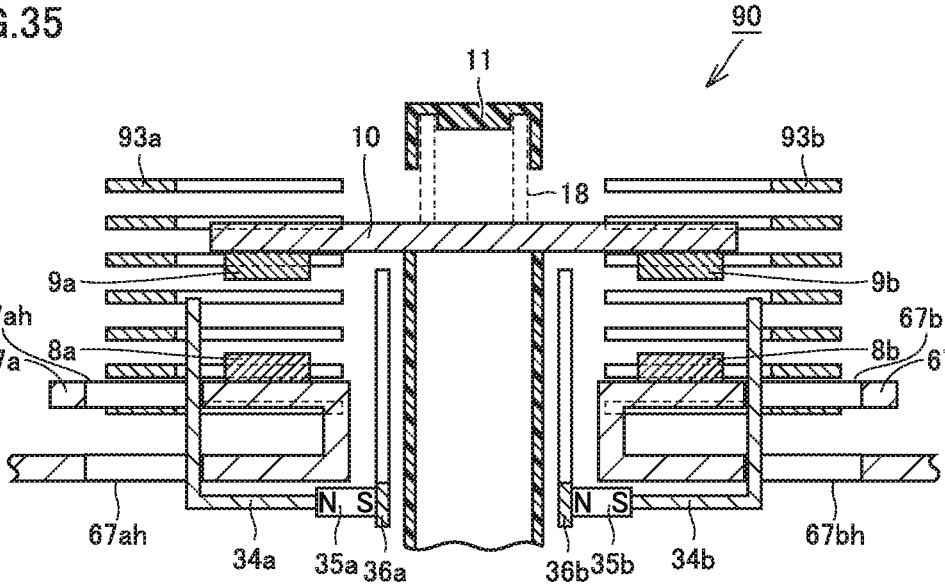
FIG. 35 is a cross-sectional view as viewed from the direction of arrows XXXV-XXXV in FIG. 34.

FIG. 34 is a partial enlarged view of the switch according to the ninth embodiment of the present invention with the arc cover removed as viewed from the front side. FIG. 35 is a cross-sectional view as viewed from the direction of arrows XXXV-XXXV in FIG. 34.

As shown in FIG. 34 and FIG. 35, switch 90 according to the ninth embodiment of the present invention includes a first fixed contact 67*a*, a second fixed contact 67*b*, a movable contact 10, a drive shaft 11, a first outside yoke 34*a*, a second outside yoke 34*b*, a first inside yoke 36*a*, a second inside yoke 36*b*, a first permanent magnet 35*a*, a second permanent magnet 35*b*, a first grid 93*a*, and a second grid 93*b*.

First grid 93*a* has a U-shaped outer shape as viewed from the axial direction of drive shaft 11. First grid 93*a* is disposed in the vicinity of first fixed contact point 8*a* and first movable contact point 9*a*. First grid 93*a* is disposed such that first fixed contact point 8*a* and first movable contact point 9*a* are located inside first grid 93*a*, as viewed from the axial direction of drive shaft 11. In the present embodiment, a plurality of first grids 93*a* are disposed to face each other with a spacing therebetween in the axial direction of drive shaft 11. However, one first grid 93*a* may be provided rather than two or more. First grid 93*a* is formed of a non-magnetic metal such as stainless steel or copper or a non-magnetic ceramic, or the like.

Second grid 93*b* has a U-shaped outer shape as viewed from the axial direction of drive shaft 11. Second grid 93*b* is disposed in the vicinity of second fixed contact point 8*b* and second movable contact point 9*b*. Second grid 93*b* is disposed such that second fixed contact point 8*b* and second movable contact point 9*b* are located inside second grid 93*b*, as viewed from the axial direction of drive shaft 11. In the present embodiment, a plurality of second grids 93*b* are disposed to face each other with a spacing therebetween in the axial direction of drive shaft 11. However, one second grid 93*b* may be provided rather than two or more. Second grid 93*b* is formed of a non-magnetic metal such as stainless steel or copper or a non-magnetic ceramic, or the like.

In the present embodiment, first outside yoke 34*a* is located inside first grid 93*a*, and second outside yoke 34*b* is located inside second grid 93*b*. However, first outside yoke 34*a* may be located outside first grid 93*a*, and second outside yoke 34*b* may be located outside second grid 93*b*.

In the present embodiment, since first grid 93*a* and second grid 93*b* are provided, after the arc is driven between first fixed contact point 8*a* and first movable contact point 9*a* and between second fixed contact point 8*b* and second movable contact point 9*b*, the arc is divided by first grid 93*a* and second grid 93*b*. Therefore, the arc voltage is increased, and the interruption performance of switch 90 can be enhanced. A plurality of first grids 93*a* and a plurality of second grids 93*b* are provided whereby the supported voltage of switch 90 can be increased.

Tenth Embodiment

The switch according to a tenth embodiment of the present invention will be described below.

The switch according to the tenth embodiment of the present invention differs from the switch in the fourth embodiment mainly in the configuration of the permanent magnet, the first outside yoke, the second outside yoke, the first inside yoke, and the second inside yoke, and a description of the configuration similar to that of the switch in the fourth embodiment is not repeated.

Figure 36:
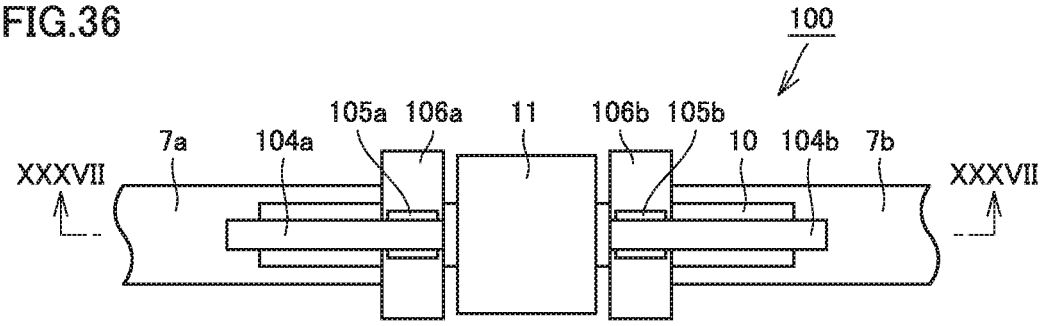
FIG. 36 is a partial enlarged view of the switch according to a tenth embodiment of the present invention with the arc cover removed as viewed from the front side.
Figure 37:
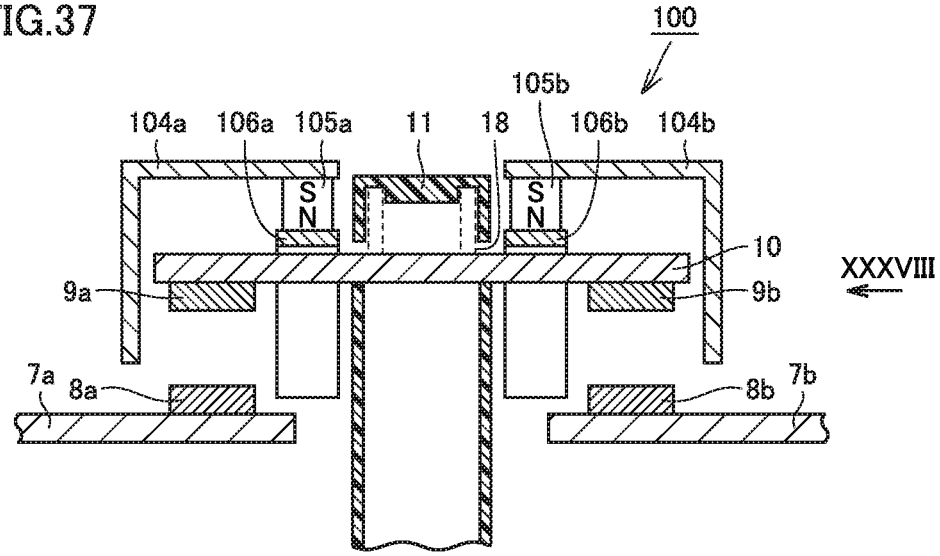
FIG. 37 is a cross-sectional view as viewed from the direction of arrows XXXVII-XXXVII in FIG. 36.
Figure 38:
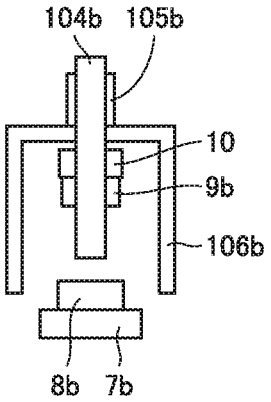
FIG. 38 is a cross-sectional view as viewed from the direction XXXVIII in FIG. 37.

FIG. 36 is a partial enlarged view of the switch according to the tenth embodiment of the present invention with the arc cover removed as viewed from the front side. FIG. 37 is a cross-sectional view as viewed from the direction of arrows XXXVII-XXXVII in FIG. 36. FIG. 38 is a cross-sectional view as viewed from the direction XXXVIII in FIG. 37.

As shown in FIG. 36 to FIG. 38, switch 100 according to the tenth embodiment of the present invention includes a first fixed contact 7*a*, a second fixed contact 7*b*, a movable contact 10, a drive shaft 11, a first outside yoke 104*a*, a second outside yoke 104*b*, a first inside yoke 106*a*, a second inside yoke 106*b*, a first permanent magnet 105*a*, and a second permanent magnet 105*b*.

Each of first inside yoke 106*a* and second inside yoke 106*b* is formed by bending a sheet of magnetic substance. Each of first inside yoke 106*a* and second inside yoke 106*b* has an inverse U-shaped outer shape so as to cover a part of movable contact 10 from above. First inside yoke 106*a* and second inside yoke 106*b* may have an integrally shaped structure.

Although it is preferable that first inside yoke 106*a* is disposed between first movable contact point 9*a* and drive shaft 11, a part of first inside yoke 106*a* may cover first movable contact point 9*a*. Although it is preferable that second inside yoke 106*b* is disposed between second movable contact point 9*b* and drive shaft 11, a part of second inside yoke 106*b* may cover second movable contact point 9*b*.

The top portion of first inside yoke 106*a* is connected to the north pole of first permanent magnet 105*a*. The top portion of second inside yoke 106*b* is connected to the north pole of second permanent magnet 105*b*. The orientation of magnetic poles of each of first permanent magnet 105*a* and second permanent magnet 105*b* may be reversed. For example, the top portion of first inside yoke 106*a* may be connected to the south pole of first permanent magnet 105*a*, and the top portion of second inside yoke 106*b* may be connected to the south pole of second permanent magnet 105*b*.

First outside yoke 104*a* is disposed above first permanent magnet 105*a*, and one end of first outside yoke 104*a* is connected to the south pole of first permanent magnet 105*a*. The other end of first outside yoke 104*a* is located in the vicinity of first fixed contact point 8*a* and first movable contact point 9*a*.

Second outside yoke 104*b* is disposed above second permanent magnet 105*b*, and one end of second outside yoke 104*b* is connected to the south pole of second permanent magnet 105*b*. The other end of second outside yoke 104*b* is located in the vicinity of second fixed contact point 8*b* and second movable contact point 9*b*.

First permanent magnet 105*a* may be connected to the top portion of first outside yoke 104*a*, and first inside yoke 106*a* may be connected to the top portion of first permanent magnet 105*a*. Similarly, second permanent magnet 105*b* may be connected to the top portion of second outside yoke 104*b*, and second inside yoke 106*b* may be connected to the top portion of second permanent magnet 105*b*.

As shown in FIG. 38, the width of each of first inside yoke 106*a* and second inside yoke 106*b* is larger than the width of each of first outside yoke 104*a* and second outside yoke 104*b*, as viewed from a direction along the extending direction of movable contact 10. With this configuration, the drive force can be exerted on the arc on either side in the above-noted width direction and thereafter effectively exerted in a direction away from movable contact 10 in the extending direction of movable contact 10, and therefore the arc can be extended longer, in the same manner as switch 40 according to the fourth embodiment. Thus, the arc-extinguishing performance of switch 100 can be further enhanced.

In the present embodiment, since each of first inside yoke 106*a* and second inside yoke 106*b* can be easily shaped, each of first inside yoke 106*a* and second inside yoke 106*b* can be formed in a smaller size, and consequently, the size of each of first-phase arc-extinguishing chamber 2*a* and second-phase arc-extinguishing chamber 2*b* can be reduced.

In the foregoing embodiments, the configurations that can be combined with each other can be combined as appropriate.

The embodiments disclosed here should be understood as being illustrative in all respects and should not be construed as being limitative. Therefore, the technical scope of the present invention should not be interpreted only by the foregoing embodiments. All modifications that come within the meaning and range of equivalence to the claims are embraced here.

REFERENCE SIGNS LIST

1, 30, 40, 50, 60, 70, 80, 90, 100 switch, 2*a*, 2*b* arc-extinguishing chamber, 3 operating coil, 4 fixed core, 5 movable core, 7*a*, 67*a* first fixed contact, 7*b*, 67*b* second fixed contact, 8*a* first fixed contact point, 8*b* second fixed contact point, 9*a* first movable contact point, 9*b* second movable contact point, 10, 10*x* movable contact, 10*a* main surface, 10*an*, 10*bn* depression, 10*b* one end surface, 10*c* the other end surface, 11 drive shaft, 11*h* hole portion, 12*a* mount, 12*b* base, 12*c* arc cover, 12*d* support, 13 grid, 14*a*, 34*a*, 44*a*, 54*a*, 104*a* first outside yoke, 14*b*, 34*b*, 44*b*, 54*b*, 104*b* second outside yoke, 15 permanent magnet, 16*a*, 26*a*, 36*a*, 46*a*, 106*a* first inside yoke, 16*b*, 26*b*, 36*b*, 46*b*, 106*b* second inside yoke, 17 insulating plate, 18 contact pressure spring, 20 magnetic flux, 26*as*, 26*bs*, 36*as*, 36*bs*, 46*as*, 46*bs* notch portion, 35*a*, 45*a*, 105*a* first permanent magnet, 35*b*, 45*b*, 105*b* second permanent magnet, 67*ah*, 67*bh* through hole, 83*a* first arc-extinguishing material, 83*b* second arc-extinguishing material, 93*a* first grid, 93*b* second grid, I current, a1, a2, a3, a4 drive force.

The invention claimed is:

1. A switch comprising:

a first fixed contact having a first fixed contact point;

a second fixed contact disposed to be aligned in a row with a gap from the first fixed contact, the second fixed contact having a second fixed contact point;

a movable contact disposed to a side of the first fixed contact point and the second fixed contact point, the movable contact having a first movable contact point at one end portion at a position facing the first fixed contact point and a second movable contact point at another end portion at a position facing the second fixed contact point;

a drive shaft formed of an insulator and disposed to pass through the gap to move the movable contact to the side;

a first outside yoke formed of a magnetic substance, a part of the first outside yoke being located at a position outside the one end portion of the movable contact in a direction in which the first fixed contact point and the second fixed contact point are aligned;

a second outside yoke formed of a magnetic substance, a part of the second outside yoke being located at a position outside the other end portion of the movable contact in the direction aligned;

a first inside yoke formed of a magnetic substance, a part of the first inside yoke being located at a position between the first fixed contact and the drive shaft;

a second inside yoke formed of a magnetic substance, a part of the second inside yoke being located at a position between the second fixed contact and the drive shaft; and a permanent magnet connected to each of the first outside yoke and the second outside yoke, wherein the permanent magnet magnetically couples the first outside yoke, the second outside yoke, the first inside yoke, and the second inside yoke, and produces a magnetic field component in the direction aligned, between the first fixed contact point and the first movable contact point and between the second fixed contact point and the second movable contact point, the movable contact extends in the direction aligned, the first movable contact point is configured to come into contact with and separate from the first fixed contact point, the second movable contact point is configured to come into contact with and separate from the second fixed contact point, the drive shaft moves the movable contact in an axial direction vertical to the direction aligned while keeping the first fixed contact point and the first movable contact point facing each other and while keeping the second fixed contact point and the second movable contact point facing each other, the permanent magnet is disposed at a position on an opposite side to the first fixed contact and the second fixed contact in the axial direction with respect to the movable contact or at a position on an opposite side to the movable contact in the axial direction with respect to the first fixed contact and the second fixed contact, a part of the first outside yoke and a part of the first inside yoke face each other between the first fixed contact point and the first movable contact point, as viewed from the direction aligned, and a part of the second outside yoke and a part of the second inside yoke face each other between the second fixed contact point and the second movable contact point, as viewed from the direction aligned.

2. A switch comprising:

a first fixed contact having a first fixed contact point;

a second fixed contact disposed to be aligned in a row with a gap from the first fixed contact, the second fixed contact having a second fixed contact point;

a movable contact disposed to a side of the first fixed contact point and the second fixed contact point, the movable contact having a first movable contact point at one end portion at a position facing the first fixed contact point and a second movable contact point at another end portion at a position facing the second fixed contact point;

a drive shaft formed of an insulator and disposed to pass through the gap to move the movable contact to the side;

a first outside yoke formed of a magnetic substance, a part of the first outside yoke being located at a position outside the one end portion of the movable contact in a direction in which the first fixed contact point and the second fixed contact point are aligned;

a second outside yoke formed of a magnetic substance, a part of the second outside yoke being located at a position outside the other end portion of the movable contact in the direction aligned;

a first inside yoke formed of a magnetic substance, a part of the first inside yoke being located at a position between the first fixed contact and the drive shaft;

a second inside yoke formed of a magnetic substance, a part of the second inside yoke being located at a position between the second fixed contact and the drive shaft; and a permanent magnet connected to each of the first outside yoke and the second outside yoke, wherein the permanent magnet magnetically couples the first outside yoke, the second outside yoke, the first inside yoke, and the second inside yoke, and produces a magnetic field component in the direction aligned, between the first fixed contact point and the first movable contact point and between the second fixed contact point and the second movable contact point, the movable contact extends in the direction aligned, the first movable contact point is configured to come into contact with and separate from the first fixed contact point, the second movable contact point is configured to come into contact with and separate from the second fixed contact point, the drive shaft moves the movable contact in an axial direction vertical to the direction aligned while keeping the first fixed contact point and the first movable contact point facing each other and while keeping the second fixed contact point and the second movable contact point facing each other, the permanent magnet is disposed at a position on an opposite side to the first fixed contact and the second fixed contact in the axial direction with respect to the movable contact or at a position on an opposite side to the movable contact in the axial direction with respect to the first fixed contact and the second fixed contact, an outer width of the first inside yoke is larger than an outer width of the first outside yoke in a width direction vertical to each of the direction aligned and the axial direction, and an outer width of the second inside yoke is larger than an outer width of the second outside yoke in the width direction.

3. The switch according to claim 1, wherein a part of the first outside yoke and a part of the first inside yoke are located between the first fixed contact point and the first movable contact point, as viewed from the direction aligned, and a part of the second outside yoke and a part of the second inside yoke are located between the second fixed contact point and the second movable contact point, as viewed from the direction aligned.

4. The switch according to claim 1, wherein the switch comprises only one permanent magnet as the permanent magnet.

5. The switch according to claim 1, wherein the first inside yoke and the second inside yoke are integrally formed.

6. The switch according to claim 1, wherein each of the first inside yoke and the second inside yoke is connected to the drive shaft.

7. The switch according to claim 1, wherein each of the first inside yoke and the second inside yoke is connected to the permanent magnet.

8. The switch according to claim 1, wherein the first outside yoke passes through a center portion of the first fixed contact in a width direction vertical to each of the direction aligned and an axial direction vertical to the direction aligned, and the second outside yoke passes through a center portion of the second fixed contact in the width direction.

9. The switch according to claim 1, wherein at least one of the first outside yoke, the second outside yoke, the first inside yoke, and the second inside yoke has an insulation coating.

10. The switch according to claim 8, wherein a slot-shaped through hole extending in the direction aligned is disposed at the center portion of the first fixed contact to allow the first outside yoke to pass through, and a slot-shaped through hole extending in the direction aligned is disposed at the center portion of the second fixed contact to allow the second outside yoke to pass through.

* * * * *